US005910072A

United States Patent [19]

Rawls et al.

[11] Patent Number: 5,910,072

[45] Date of Patent: Jun. 8, 1999

[54] EXERCISE APPARATUS

[75] Inventors: R. Lee Rawls, Woodinville; James A. Duncan, Newcastle; John Arthur Ohrt, Redmond, all of Wash.

[73] Assignee: StairMaster Sports/Medical Products, Inc., Kirkland, Wash.

[21] Appl. No.: 08/984,573

[22] Filed: Dec. 3, 1997

[51] Int. Cl.[6] ..... A63B 22/00

[52] U.S. Cl. ..... 482/51; 482/52

[58] Field of Search ..... 482/51, 52, 53, 482/54, 57, 70, 71, 79, 80

[56] References Cited

U.S. PATENT DOCUMENTS

| | | | |
|---|---|---|---|
| 3,756,595 | 9/1973 | Hague | 272/70 |
| 4,720,093 | 1/1988 | Del Mar | 272/70 |
| 4,940,233 | 7/1990 | Bull et al. | 272/130 |
| 5,000,443 | 3/1991 | Dalebout et al. | 272/70 |
| 5,039,088 | 8/1991 | Shifferaw | 272/73 |
| 5,078,389 | 1/1992 | Chen | 272/70 |
| 5,242,343 | 9/1993 | Miller | 482/57 |
| 5,290,211 | 3/1994 | Stearns | 482/53 |
| 5,299,993 | 4/1994 | Habing | 482/52 |
| 5,336,141 | 8/1994 | Vittone | 482/51 |
| 5,352,169 | 10/1994 | Eschenbach | 482/57 |
| 5,383,829 | 1/1995 | Miller | 482/57 |
| 5,419,747 | 5/1995 | Piaget et al. | 482/51 |
| 5,496,235 | 3/1996 | Steven | 482/51 |
| 5,499,956 | 3/1996 | Habing et al. | 482/52 |
| 5,518,473 | 5/1996 | Miller | 482/57 |
| 5,536,224 | 7/1996 | Hsieh | 482/51 |
| 5,562,574 | 10/1996 | Miller | 482/51 |
| 5,573,480 | 11/1996 | Rodgers, Jr. | 482/57 |
| 5,584,781 | 12/1996 | Chen | 482/51 |
| 5,593,371 | 1/1997 | Rodgers, Jr. | 482/51 |
| 5,593,372 | 1/1997 | Rodgers, Jr. | 482/52 |
| 5,595,555 | 1/1997 | Chen | 482/51 |
| 5,605,521 | 2/1997 | Hsieh | 482/51 |
| 5,611,756 | 3/1997 | Miller | 482/52 |
| 5,613,924 | 3/1997 | Lee | 482/51 |
| 5,624,354 | 4/1997 | Chen | 482/51 |
| 5,637,058 | 6/1997 | Rodgers, Jr. | 482/51 |
| 5,643,140 | 7/1997 | Tsai | 482/51 |
| 5,655,998 | 8/1997 | Yu | 482/51 |
| 5,685,804 | 11/1997 | Whan-Tong et al. | 482/51 |
| 5,708,060 | 1/1998 | Sands et al. | 524/14 |
| 5,709,632 | 1/1998 | Socwell | 482/54 |
| 5,720,698 | 2/1998 | Dalebout et al. | 482/52 |

*Primary Examiner*—Stephen R. Crow
*Attorney, Agent, or Firm*—Seed and Berry LLP

[57] ABSTRACT

An exercise apparatus having right and left foot pedals with a forward end thereof pivotally supported by right and left swing arms and a rearward end thereof pivotally supported by right and left lift arms. In an alternative embodiment, a lift cable is used. A swing control member interconnects the swing arms to provide a dependent action with the rearward movement of one pedal causing the forward movement of the other, and an interconnect member interconnects the rearward end portions of the pedals to provide a dependent action with the downward movement of the rearward end of one pedal causing the rearward end of the other pedal to move upward. The swing control member and the interconnect member are operatively disconnected such that while the forward and rearward movement of the right and left pedals have dependent action and the downward and upward movement of the right and left pedals have dependent action, the forward and rearward movements and the downward and upward movements are independent of each other. A resistance device resists rearward movement of the right and left pedals.

101 Claims, 19 Drawing Sheets

EXERCISE APPARATUS

TECHNICAL FIELD

The present invention relates generally to exercise equipment, and more particularly, to a stationary exercise apparatus which allows the user to exercise using natural striding and stepping in place motions.

BACKGROUND OF THE INVENTION

A variety of exercise apparatus exists which allow the user to exercise by simulating a striding motion. Some of these devices also allow a stepping motion. For example, U.S. Pat. No. 5,000,443 illustrates a striding exerciser having right and left foot pedals, each fixedly attached to a lower end of a corresponding one of right and left swing arms. The swing arms each have an upper end pivotally attached to a frame. The user stands on the right and left pedals and exercises by swinging his legs back and forth to simulate striding. Each of the pedals is able to move rearward and forward along a manufacturer defined arcuate path about the pivot axis of the upper end of the swing arm which carries the pedal. A cable interconnects the right and left swing arms such that when one pedal moves rearward the other is moved forward, and vice versa, to provide a dependent reciprocal swinging action. The exerciser allows the user to use a stride length when exercising that is natural to the user, but the motion of the foot pedals and thus the user's foot thereon is constrained to a reciprocating motion along the simple arcuate path with no significant variation in pedal angle simulating stride height (heel lift) possible. To experience a change in foot angle during a stride which has a heel lift more natural to a striding motion, a user must lift his foot at least partially off the pedal or rock his foot on the pedal.

A similar striding exerciser shown in U.S. Pat. No. 5,613,924 which utilizes right and left swing arms which pivot independent of each other. Again, the foot pedals are constrained to move along a simple arcuate path with no significant variation in stride height.

A different style design for a striding exerciser is shown in U.S. Pat. Nos. 5,242,343; 5,383,829; 5,518,473 and 5,562,574. In these exercisers the right and left foot pedals are carried on a corresponding one of right and left foot links, each foot link having one end attached to a corresponding one of right and left bell cranks of a fly wheel. The other end of each foot link is guided by a corresponding one of right and left tracks or suspended by a corresponding one of right and left swing arms. With this arrangement, an ovate, open foot path is possible such that when exercising on the apparatus the user experiences a stride that has both a stride length and a stride height. A limited degree of adjustability is provided in at least one disclosed embodiment to adjust the incline of the foot pedals prior to commencing an exercise by use of connector pins and a plurality of pin receiver holes, with the adjustment being made before the exercise begins. However, with these exercisers, the stride length and stride height of the user is determined entirely by the construction of the exerciser with no variability for the natural stride length or height of a particular user. Further, there is no ability to vary the stride length or height while an exercise is in progress in response to the user naturally or by choice changing his stride length or height. Users of varying sizes and with different natural stride lengths and heights must all move their feet along the same manufacturer defined ovate path.

A striding exerciser which permits the user to stride using his natural stride length and stride height is shown in U.S. Pat. Nos. 5,299,993 and 5,499,596. In the disclosed exerciser, the right and left pedals are each supported on a corresponding one of right and left articulated linkage assemblies. Each linkage assembly includes a generally vertical arm having an upper end pivotally attached to a frame and a lower end pivotally attached to a forward end of a generally horizontal arm comprising a pair of arm members in four bar arrangement. The free rearward end of the generally horizontal arm supports one of the foot pedals. The exerciser uses rollers below each horizontal arm to support the arm from below and limit downward travel thereof when the user's weight is applied to the pedal carried by the arm. The right and left linkage assemblies operate independent of each other and allow the user to move his feet with a natural stride length and stride height while exercising without being constrained to a fixed manufacturer defined pedal path. The exerciser, however, has a less than desirable construction and operation. Further, in one disclosed embodiment, the vertical arms are coupled to a crank assembly which undesirably constrains the user to a fixed stride length which may not simulate the natural stride length of the user.

It will, therefore, be appreciated that there has been a need for a striding exerciser which can be used for striding exercises such as walking, jogging and running, and stepping in place exercises which accommodates the natural stride length and stride height of the user, and does not constrain the user to a fixed stride length or height which may not match the user. The exerciser should allow the user to change the stride length and height being used during the progress of an exercise without requiring the user to adjust equipment settings. Such a striding exerciser should provide a strong and durable construction and operate with an exercise feel which is more desirable to users than presently available striding exercisers. The present invention fulfills these needs and further provides other related advantages.

SUMMARY OF THE INVENTION

The present invention resides in an exercise apparatus allowing a user to exercise while standing on the user's feet. The apparatus includes right and left foot pedals laterally spaced apart, each having a forward end portion sized to receive a forward end portion of the user's corresponding foot thereon and a rearward end portion sized to receive a rearward end portion of the user's corresponding foot thereon. The apparatus further includes right and left pedal support members, which in the illustrated embodiments include right and left swing arms supporting the right and left pedals, respectively. The swing arms have an upper end portion pivotally attached to a frame to swing rearward and forward relative thereto and a lower end portion pivotally attached to the forward end portion of the corresponding pedal for rearward and forward reciprocating movement of the pedals with the swing arms in user variable rearward and forward amounts during an exercise.

The right and left pedal support members also support the right and left pedals for downward and upward pivotal movement of the rearward end portions thereof relative to the forward end portions thereof in user variable downward and upward amounts during an exercise.

The apparatus further includes right and left heel lift members attached to the rearward end portion of the corresponding right and left pedal such that in response to a downward movement of the rearward end portion of one pedal a corresponding upward movement of the rearward end portion of the other pedal is produced.

In one illustrated embodiment, the right and left heel lift members include a cable, and in another illustrated embodiment include right and left lift arms with an upper end pivotally attached to the frame and a lower end pivotally attached to the rearward end portion of the corresponding right or left pedal.

The apparatus further includes a swing control member engaging the right and left pedal support members such that rearward movement of one of the right and left pedals causes forward movement of the other.

In the illustrated embodiments, the components for producing the dependent rearward and forward motion of the right and left pedals and the dependent downward and upward motion of the rearward end portions of the right and left pedals are operatively disconnected. As such, the rearward and forward movement of the pedals and the downward and upward movement of the pedals are independent of each other. In the illustrated embodiments, a resistance device is operatively coupled to the right and left pedal support members to resist the rearward movements thereof. Further, a spring assembly is used to cushion the end limit of downward travel of the rearward end portions of the right and left pedals and to limit the extent of downward travel.

Other features and advantages of the invention will become apparent from the following detailed description, taken in conjunction with the accompanying drawings.

DETAILED DESCRIPTION OF THE INVENTION

Figure 1:
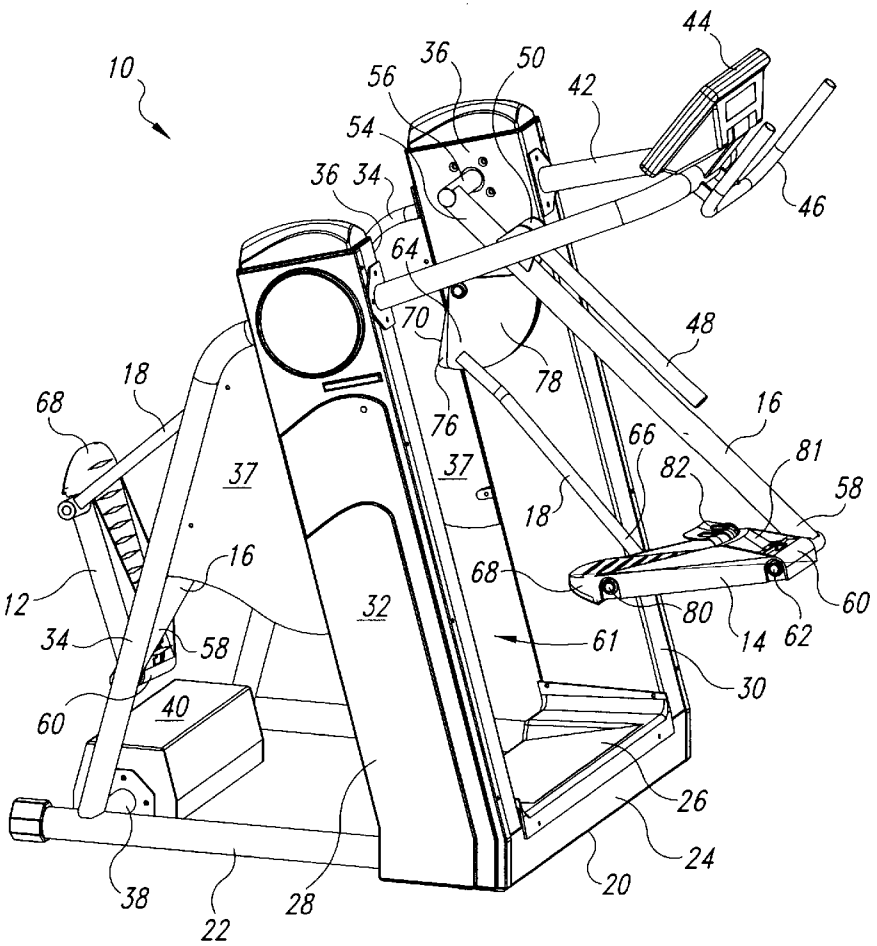
FIG. 1 is a front, right side isometric view of a striding exercise apparatus embodying the present invention, showing right and left foot pedals substantially fully extended rearward and forward, respectively.

As shown in the drawings for purposes of illustration, the present invention is embodied in an exercise apparatus, indicated generally by reference numeral 10. The apparatus 10 allow the user to primarily exercise the user's lower body while standing on the exercise apparatus and moving the user's legs and feet in a variety of motions simulating the motion of running, jogging and walking, and the motion of stepping in place, all referred to herein as "striding" with varying amounts of stride length and stride height. The apparatus 10 accommodates a variety of stride lengths of the user and allows the user to change the length of stride while an exercise is in progress without requiring any adjustment by the user of equipment settings. The apparatus 10 automatically and immediately moves in response to the stride length used by the user during the exercise and allows infinite user variability of the stride length throughout a large stride length range at any time during the exercise. As used herein, stride length refers to the distance between rearward and forward end extents of travel of the foot of the user during an exercise repetition.

The apparatus 10 further accommodates a variety of stride heights of the user and allows the user to change the height of stride while an exercise is in progress without requiring any adjustment by the user of equipment settings. The apparatus 10 automatically and immediately moves in response to the stride height used by the user during the exercise and allows infinite user variability of the stride height throughout a large stride height range at any time during the exercise. As used herein, stride height refers to the distance between downward and upward end extents of travel of the heel portion of the user's foot during an exercise repetition. Alternately referred to as heel lift, the amount of stride height is indicative of the angle of the user's foot during the exercise repetition.

The apparatus 10 allows the user to vary the stride length independent of the stride height, and vice versa, thereby allowing the user to engage in a natural stride length and stride height during the exercise without being constrained to a particular stride length or height selected by the manufacturer to be used by all users without variation. Further, the apparatus 10 allows the user to infinitely vary the stride length or stride height, or both, while the exercise is in progress, as desired by the user, without adjustment of equipment settings. The apparatus 10 also provides for dependency in the right and left foot rearward and forward movements, and dependency in the right and left foot downward and upward movements, as will be described in greater detail below.

The result is an exercise apparatus with improved construction and feel, and greater flexibility and ease in operation which can simulate all striding type motions from running to stepping in place with stride length and height movements that match the natural movements for the user, and which automatically changes pedal stride length and height while the exercise is in progress in response to any changes in stride length and height used by the user.

Figure 2:
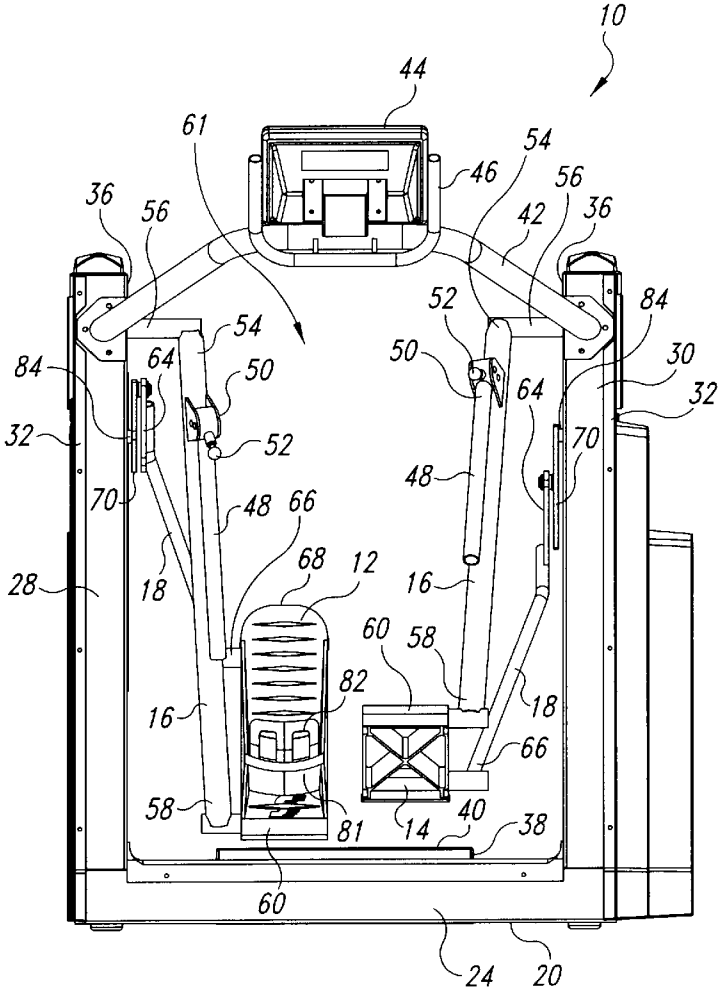
FIG. 2 is a front elevational view of the exercise apparatus of FIG. 1.
Figure 3:
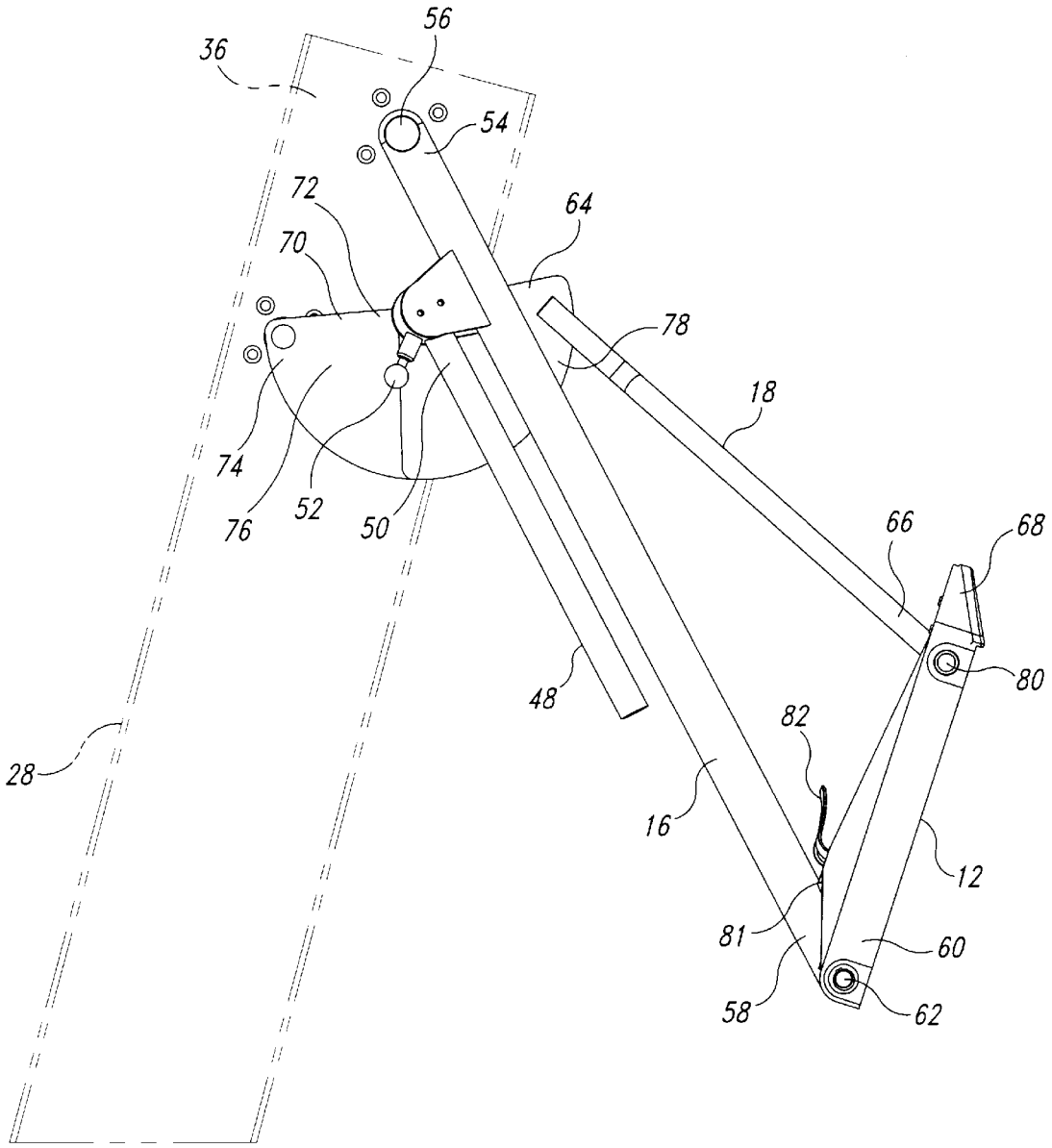
FIG. 3 is a left side elevation view of a right side pedal assembly of the exercise apparatus of FIG. 1, showing an upright right side support frame in phantom line.

For purpose of illustration, a first embodiment of the apparatus 10 is shown fully assembled in FIGS. 1 and 2. The apparatus 10 is configured for a human user 2 (shown in FIGS. 4, and 7–9) to exercise while standing with the user's right and left feet 4 and 6, respectively, on laterally spaced apart right and left foot pedals 12 and 14, respectively. Each of the pedals 12 and 14 is suspended from above by a forwardly positioned swing arm 16 and a rearwardly positioned lift arm 18. The apparatus 10 includes a stationary frame 20 having ground engaging right and left side laterally spaced apart base frame members 22. A forward base frame member 24 is fixedly attached to the forward ends of the right and left side base frame members 22 and extends therebetween. The forward base frame member 24 is an upwardly open channel with a top cover 26. Upright, laterally spaced apart right and left side support frame members 28 and 30, respectively, have a lower end portion fixedly attached to a corresponding one of the right and left end portions of the forward base frame member 24 and extend upwardly therefrom. The right and left side support frame members 28 and 30 are outwardly open channels with covers 32.

Figure 10:
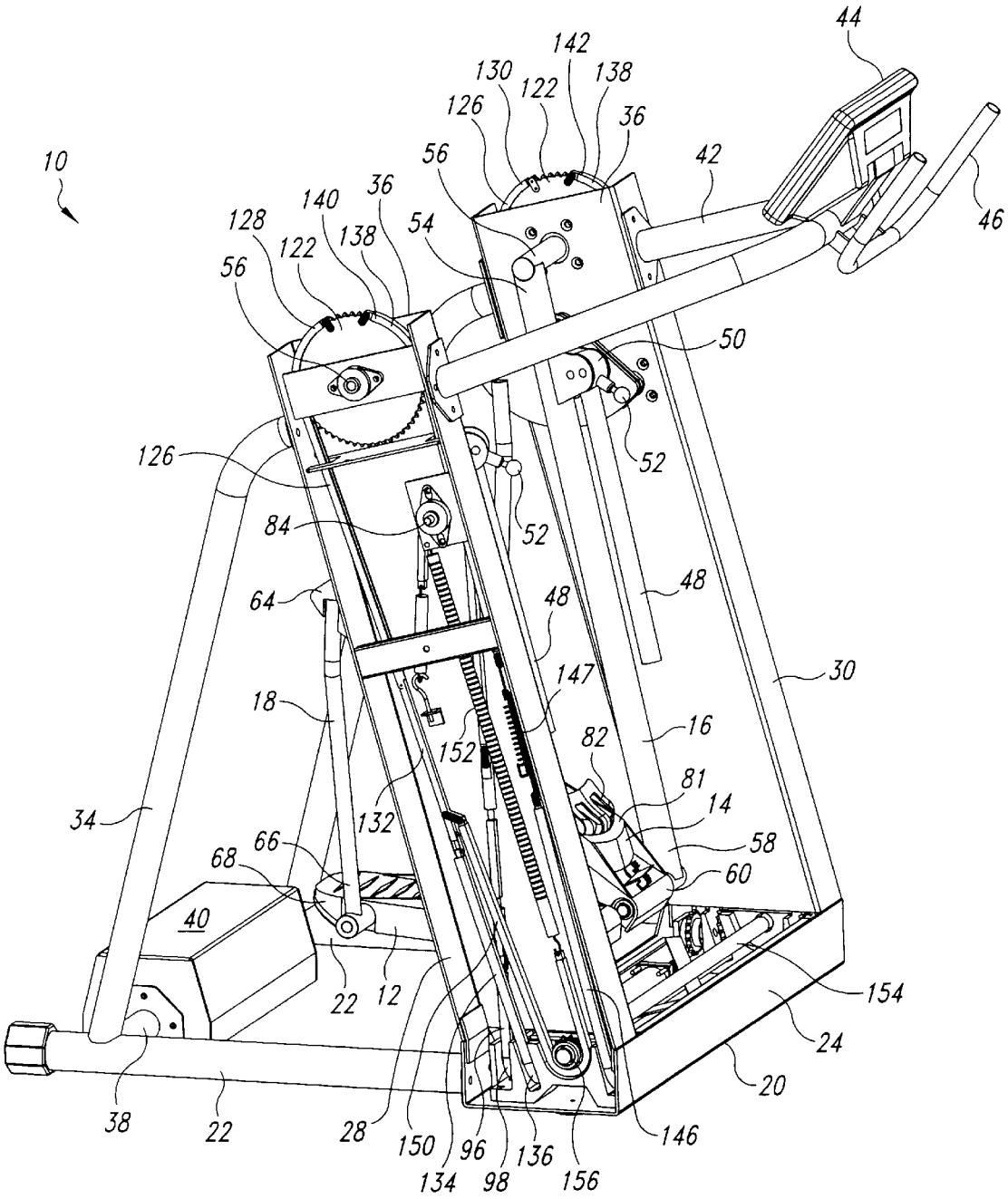
FIG. 10 is a front, right side isometric view of the exercise apparatus of FIG. 1 with the right and left side support frame and front covers removed.

It is noted that the right and left pedals 12 and 14 and the swing arm and lift arms 16 and 18 that support them are shown in FIGS. 1 and 2 with the right pedal 12 positioned substantially fully rearward and the left pedal 14 positioned substantially fully forward as would be the case when in use with a user thereon exercising with a striding motion. When the exercise apparatus 10 is at rest, such as shown in FIG. 10, the right and left pedals 12 and 14 assume a central neutral position substantially directly below the location at which the right and left swing arms 16 and the right and left lift arms 18 are pivotally attached to the right and left side support frame members 28 and 30.

The frame 20 has added support provided to the right and left side support frame members 28 and 30 by a pair of rear support frame members 34. Each of the rear support frame members 34 has a lower end fixedly attached to a rearward end portion of the corresponding one of the right and left side base frame members 22. An upper end of each rear support frame member 34 is attached to a rearward face of an upper end portion 36 of the corresponding one of the right and left side support frame members 28 and 30. A protective plate 37 spans the distance between an upper portion of each of the rear support frame members 34 and the corresponding one of the right and left side support frame members 28 and 30, the plate 37 being shown in only FIG. 1. A rear base frame member 38 extends between and is fixedly attached to a rearward end portion of each of the right and left side base frame members 22. A central portion of the rear base frame member 38 is configured to serve as a step 40 to facilitate a user standing behind the apparatus 10 stepping onto the right and left pedals 12 and 14 to perform an exercise.

A handlebar 42 is fixedly attached to a forward face of the upper end portions 36 of the right and left side support frame members 28 and 30. The handlebar 42 has right and left side portion which project forwardly and somewhat inwardly and meet with a transverse portion to which a control panel 44 is mounted. The transverse portion of the handlebar 42 also has attached thereto a pair of handgrips 46 for grasping by the right and left hands of the user when standing on the right and left pedals 12 and 14 during an exercise as an alternative to grasping the handlebar 42. The apparatus 10 also includes right and left handles 48 attached to a forward side of the corresponding one of the swing arms 16 which may be grasped by the user while standing on the right and left pedals 12 and 14 during an exercise to achieve upper body exercise. A base end portion 50 of each handle 48 is pivotally mounted to the swing arm for angular adjustable movement relative thereto and projects forward from the swing arm. A user operable locking pin 52 allows the user to lock the handle 48 in a selected angular orientation relative to the corresponding one of the right and left swing arms 16 for travel of the handles 48 at the selected angle with the swing arm during an exercise. The handles 48 are illustrated in the drawings folded down against the swing arms 16, but when used would be rotated to a more upwardly projecting position relative thereto. The handles 48 allow the user to apply a forward and downward force thereon with his hands during an exercise to selectively help drive the right and left swing arms 16 rearward during the exercise and in so doing, the user achieves upper body exercise.

Each of the right and left swing arms 16 has an upper end portion 54 pivotally attached to the upper end portion 36 of a corresponding one of the right and left side support frame members 28 and 30 by a shaft 56 to swing rearward and forward relative to the frame members. The right and left swing arms 16 are generally upwardly oriented or extending, and each is located laterally inward of an inward face of the corresponding one of the right and left side support frame members 28 and 30. A lower end portion 58 of each of the right and left swing arms 16 has a forward end portion 60 of the corresponding one of the right and left pedals 12 and 14 pivotally attached thereto for rearward and forward reciprocating movement of the pedal with the swing arm. The forward end portion 60 of the right and left pedals 12 and 14 is sized to receive a forward end or toe portion of the user's corresponding right or left foot thereon. As will be described in greater detail below, the right and left swing arms 16 move the right and left pedals 12 and 14 attached thereto with rearward and forward reciprocating movement along an arcuate path as the swing arms move rearward and forward in user variable rearward and forward amounts during an exercise.

The right and left pedals 12 and 14 are each located laterally inward of the right and left swing arm 16 to which they are attached. Hence, the swing arm to which the pedal is attached is located between the corresponding one of the right and left side support frame members 28 and 30 and the pedal and define a space 61 between the right and left swing arms in which the user 2 stands while on the right and left pedals 12 and 14 during an exercise. The right and left swing arms 16 support the forward end portion 60 of the corresponding right and left pedals 12 and 14 in cantilevered fashion on a pivot pin 62 which extends fully from side to side through the forward end portion 60 of the corresponding pedal.

Each of the right and left lift arms 18 has an upper end portion 64 pivotally attached through a corresponding one of right and left pivot links 70 to the upper end portion 36 of the corresponding one of the right and left side support frame members 28 and 30, at a location below the location of pivotal attachment of the corresponding one of the right and left and swing arms 16 and outward of the upper end portion 54 of the corresponding right and left swing arms 16. The right and left lift arms 18 are generally upwardly oriented or extending and each is located laterally inward of the inward face of the corresponding one of the right and left side support frame members 28 and 30. A lower end portion 66 of each of the right and left lift arms 18 is pivotally attached to a rearward end portion 68 of the corresponding one of the right and left pedals 12 and 14.

The rearward end portion 68 of the right and left pedals 12 and 14 is sized to receive a rearward end or heel portion of the user's corresponding right or left foot thereon. The forward end portion 60 and rearward end portion 68 of each of the right and left pedals 12 and 14 are sized sufficiently large to receive the right and left feet 4 and 6 thereon of a wide variety of users both below and above the size of the average adult foot. As will be described in greater detail below, the right and left lift arms 18 provide a lifting force to the rearward end portions 68 of the right and left pedals 12 and 14 attached thereto to move upward the pedals and provide stride height during an exercise repetition in user variable amounts during an exercise. Additionally, the right swing arm and right lift arm together provide swinging support for the right pedal 12 and limit downward travel thereof to provide uninhibited swinging movement of the right pedal out of supporting contact with any structure therebelow during an exercise. Similarly, the left swing arm and left lift arm together provide swinging support for the left pedal 14 and limit downward travel thereof to provide uninhibited swinging movement of the left pedal out of supporting contact with any structure therebelow during an exercise.

Figure 4:
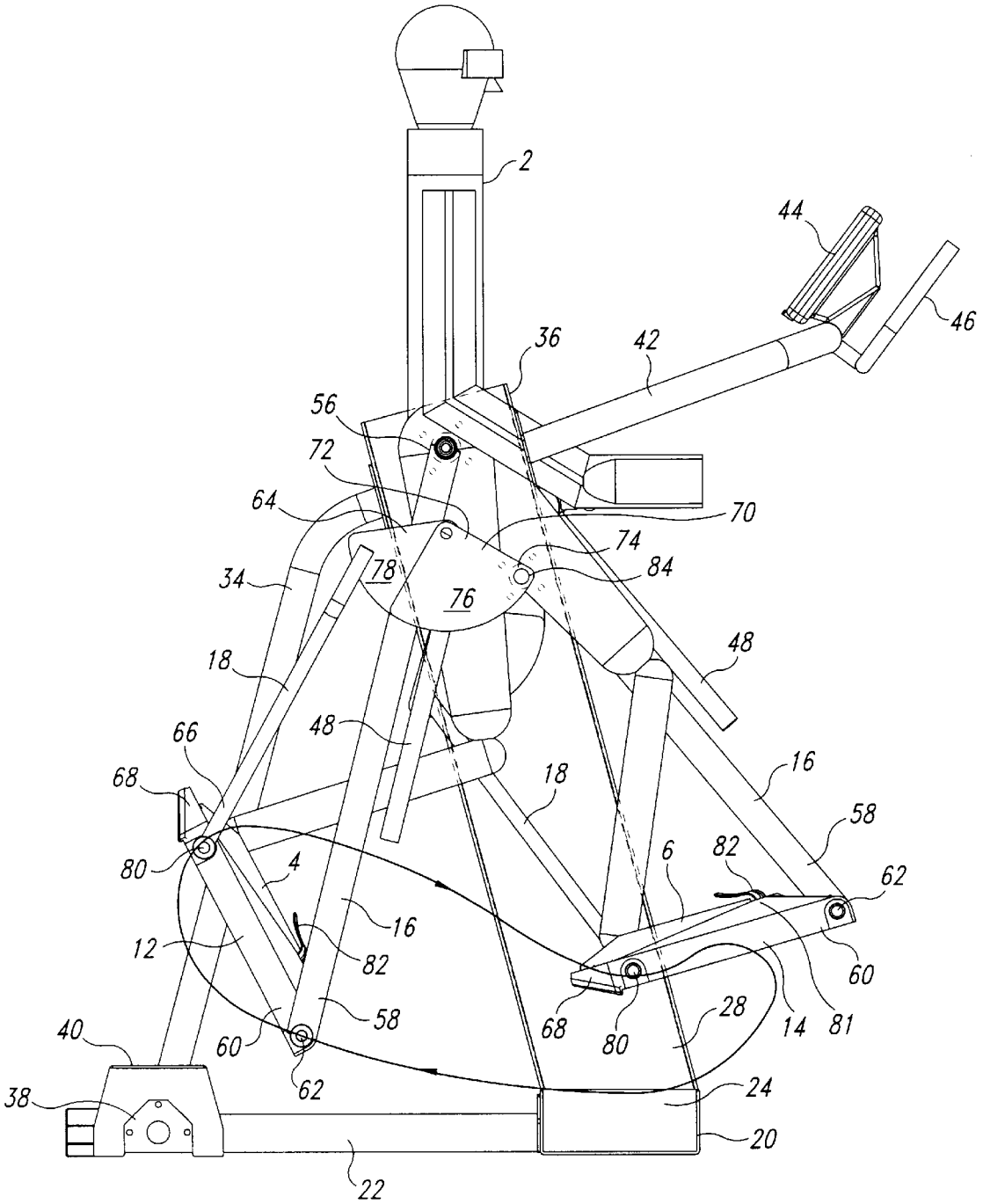
FIG. 4 is a right side schematic elevational view of the exercise apparatus of FIG. 1 showing a user exercising with a running stride and illustrating rearward pedal pivot and forward pedal pivot travel loops.

The construction and operation of the right and left pivot links 70 are best illustrated in FIGS. 4, 7, 8 and 9. Referring to FIG. 4, the upper end portion 64 of the right lift arm 18 is shown pivotally attached to a free first end portion 72 of the right pivot link 70. A second end portion 74 of the right pivot link 70 is pivotally attached to the upper end portion 36 of the right side support frame member 28. The left pivot link 70 is of identical construction and operation with the free first end portion 72 thereof pivotally attached to the upper end portion 64 of the left lift arm 18 and the second end portion 74 thereof pivotally attached to the upper end portion 36 of the left side support frame member 30. To reduce the opportunity for fingers of the user to be pinched between the upper end portion 64 of the lift arm and the pivot link 70, the pivot link is formed with a hand guard plate portion 76 and the upper end portion 64 of the lift arm 18 is formed with a hand guard plate portion 78 which overlap.

The right and left pedals 12 and 14 are each located laterally inward of the right and left lift arms 18 to which attached. Hence, the lift arm to which the pedal is attached is located between the corresponding one of the right and left side support frame members 28 and 30 and the pedal, and define a rearward portion of the space 61 in which the user 2 stands while on the right and left pedals 12 and 14 during an exercise. Further, the right and left lift arms 18 are positioned rearward of the corresponding one of the right and left swing arms 16. The right and left lift arms 18 pivotally support the rearward end portion 68 of the corresponding right and left foot pedals 12 and 14 in a cantilevered fashion on a pivot pin 80 which extends fully from side to side through the rearward end portion 68 of the corresponding pedal.

Each of the right and left pedals 12 and 14 has a foot stop 81 attached thereto and a toe clip 82 into which the toe portion of the user's foot is positioned when on the pedal. The right and left toe clips 82 are positioned on the corresponding one of the right and left pedals 12 and 14 to engage and limit forward positioning of the toe portion of the user's foot placed thereon at a position rearward of the pivot pin 62, the location of the pivotal attachment of the lower end portion 58 of the corresponding right and left swing arms 16 to the forward end portion 60 of the corresponding right and left foot pedals 12 and 14. As will be described below, by locating the toe portion of the user's foot behind the pivotal attachment point of the swing arm to the foot pedal, the user's toe traces out a path of travel more in accordance with a natural movement than the simple reciprocating arcuate movement traced out by the pivot pin 62 as the right and left swing arms 16 swing rearward and forward.

Figure 5:
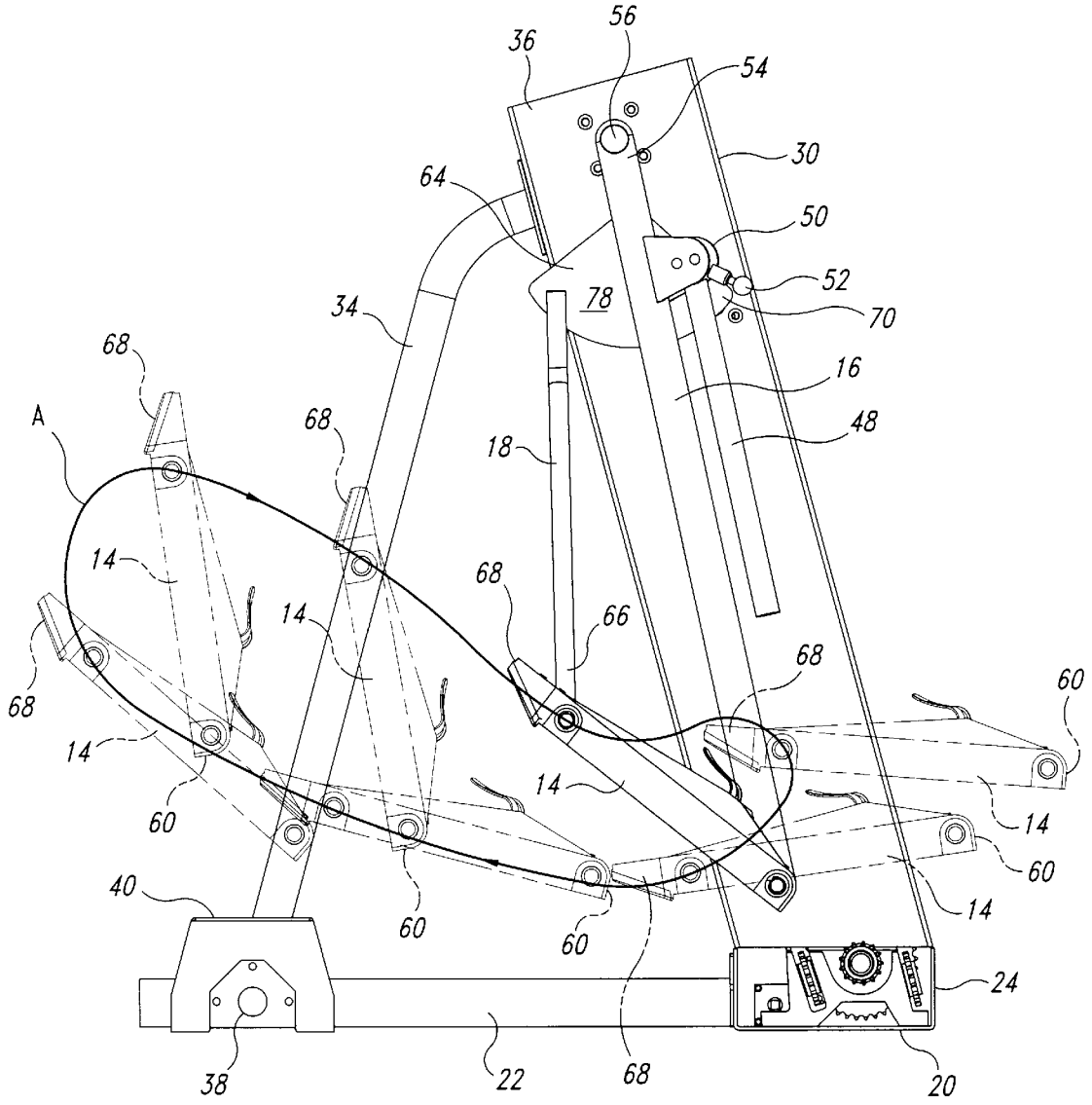
FIG. 5 is a fragmentary, right side schematic elevational view of the left side pedal assembly of the exercise apparatus of FIG. 1, showing an upright left side support frame and the left pedal in various positions as the user exercises with a running stride producing a rearward pedal pivot travel loop similar to that shown in FIG. 4.

Further description of the construction and operation of the apparatus 10 will be provided below, however, to understand the basic operation of the apparatus 10 reference is made to FIGS. 4–9 which show the apparatus in somewhat schematic form, and in several figures show the user 2 positioned in the space 61 between the right swing and pivot arms and the left swing and pivot arms, with the user's right foot 4 on the right pedal 12 and the user's left foot 6 on the left pedal 14. In FIG. 4, the user 2 is shown exercising with a striding motion simulating running using a substantial stride length, i.e., the travel distance of the user's foot during an exercise repetition between the rearward and forward most extents of its travel, and a substantial stride height, i.e., the travel distance of the heel portion of the user's foot during an exercise repetition between the downward and upward most extents of its travel. The resulting path of travel of the right and left pedals 12 and 14 measured at the pivot pin 80, located immediately below the heel portion of the user's foot, at the pivotal attachment point of the lift arm 18 to the corresponding right and left pedals 12 and 14, is shown as an ovate, open travel loop for an exercise repetition, and is indicated in the drawings by reference letter A. The arrowheads on the path A indicate the direction of travel of the heel portion of the user's foot along the path during an exercise repetition. The various pedal positions along an exercise repetition with a similar striding motion are shown in FIG. 5, with positions of the left pedal 14 illustrated.

Figure 7:
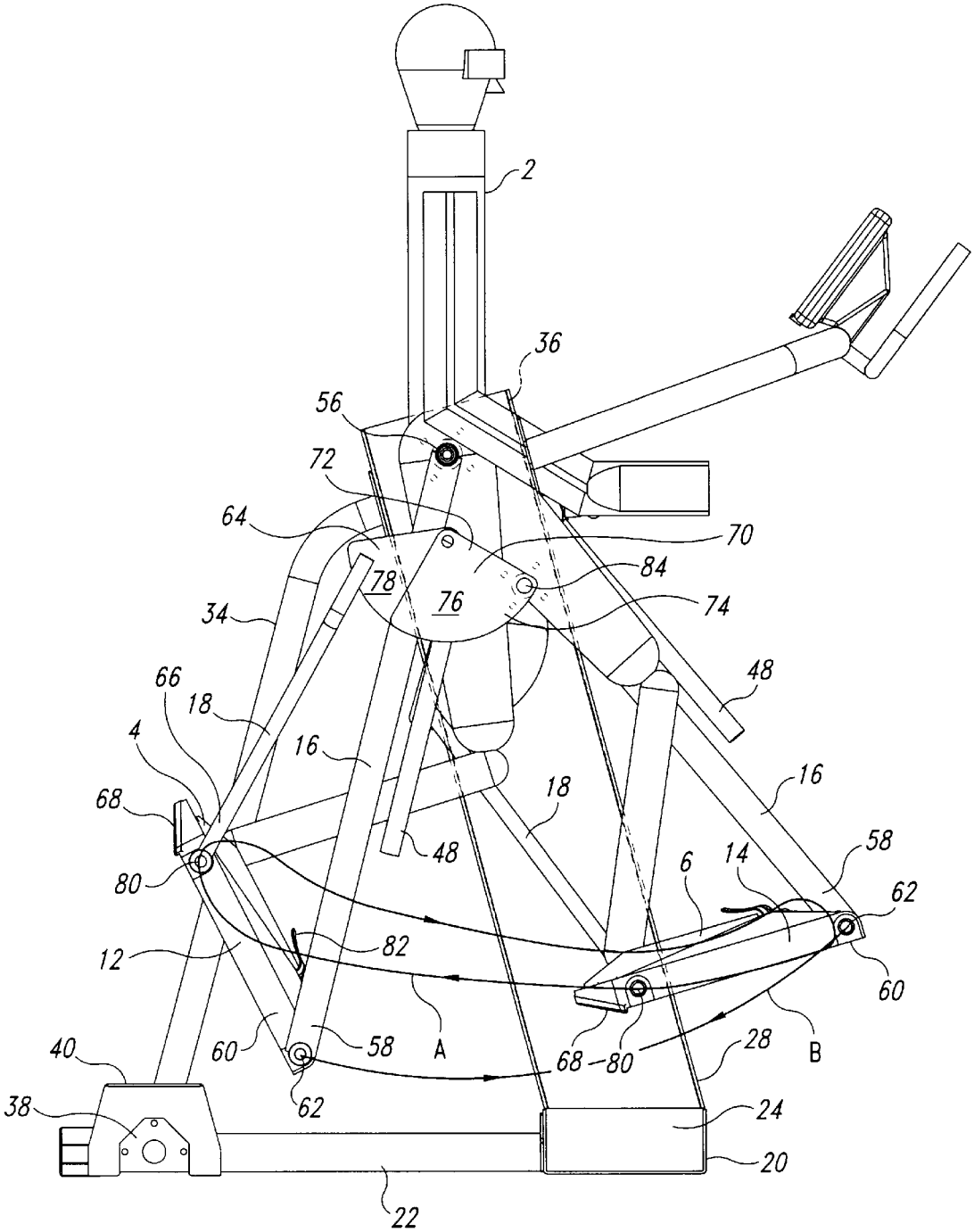
FIG. 7 is a right side schematic elevational view of the exercise apparatus of FIG. 1 showing the user exercising with a running length stride having little stride height as in a leg swinging motion and illustrating the rearward pedal pivot and forward pedal pivot travel loops.

The vertical height of the open loop travel path A indicates the amount of heel lift the user 2 is applying with his right and left feet 4 and 6 to the right and left pedals 12 and 14 of the apparatus 10 during an exercise repetition. A particular user which has a naturally large heel lift while striding will trace out a much more open heel travel path A, with the lower segment length of the path A traced out as the heel moves rearward being significantly spaced apart from and below the upper segment of the path A traced out as the heel moves forward. Since the toe portion of the user's foot is positioned further forward of the pivot pin 80 and closer to the pivot pin 62, the toe portion is moved along a path of travel with much less vertical height variation, as will be described in more detail below. As a result of the larger variations in heel movement relative to toe movement, an angular variation of the feet relative to the legs is experienced by the user during an exercise. As will be described below, since the apparatus 10 responds to user foot movements, different users may use different stride heights, and even the same user may use different stride heights during an exercise to simulate striding with a natural stride height for the user. The stride height may be varied by the user by choice or as a result of normal factors that naturally vary the stride length used, such as speed of exercise, stride length, style used or state of tiredness. This allows every user of the apparatus 10, all times during an exercise, to use a natural stride height which can vary during the exercise. The change in stride height can be seen in FIG. 7 for the user 2 using substantially the same stride length but with a significantly reduced stride height. The rearward movement lower segment of the heel travel path A is very close to the forward movement upper segment of the heel travel path A. The motion shown in FIG. 7 is substantially one of the user simply swinging his legs rearward and forward.

Figure 8:
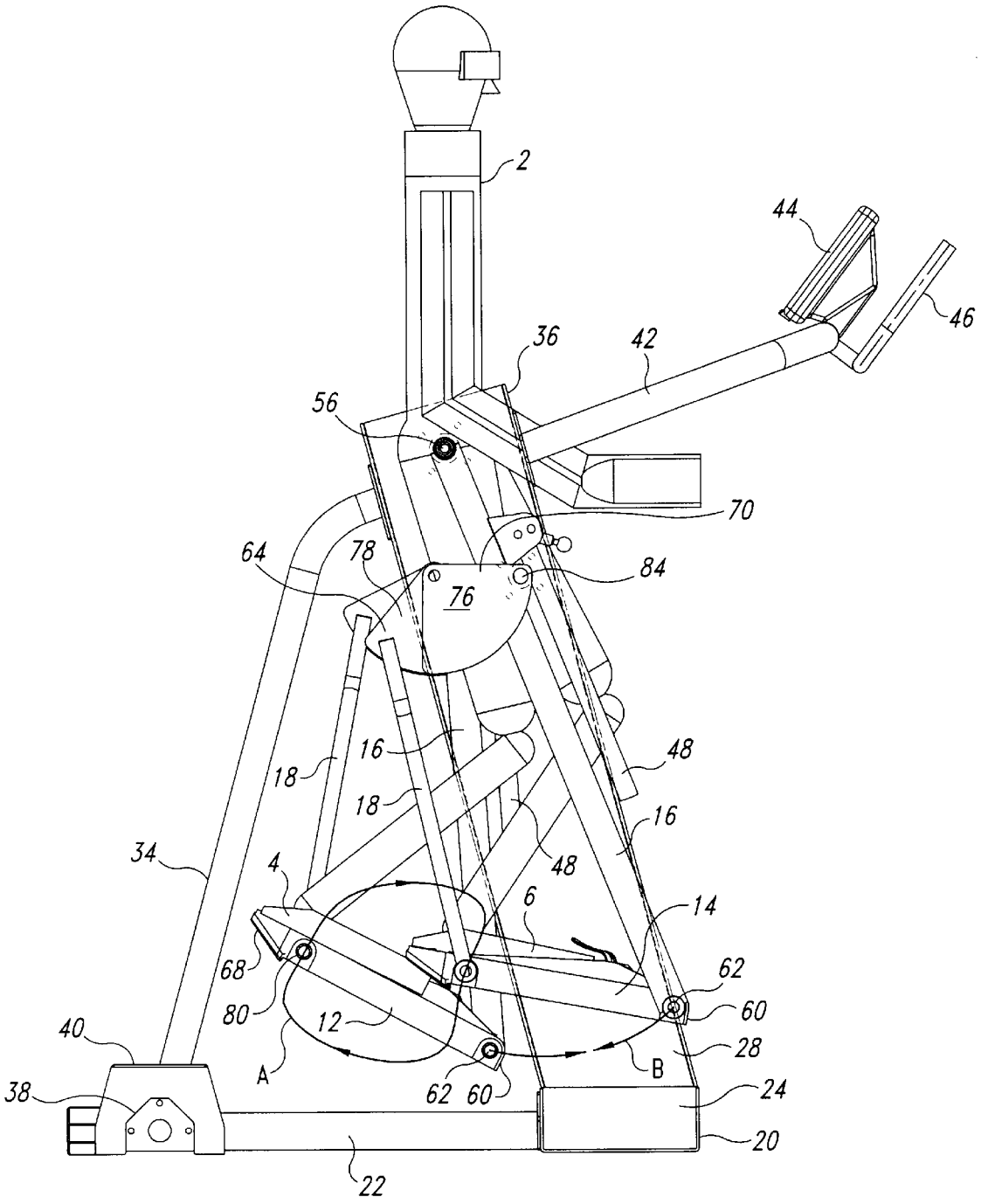
FIG. 8 is a right side schematic elevational view of the exercise apparatus of FIG. 1 showing the user exercising with a jogging stride having a shortened stride length and illustrating the rearward pedal pivot and forward pedal pivot travel loops.

The user 2 is shown in FIG. 8 exercising with a striding motion having a much shorter stride length, but with a substantial stride height to simulate jogging. Again, the stride height of heel travel path A is responsive to the stride height used by the user 2, and may be changed as desired by any time in any amount by the user during the exercise. Different stride heights may be used by other users who subsequently use the apparatus 10, without changing any equipment settings.

Figure 9:
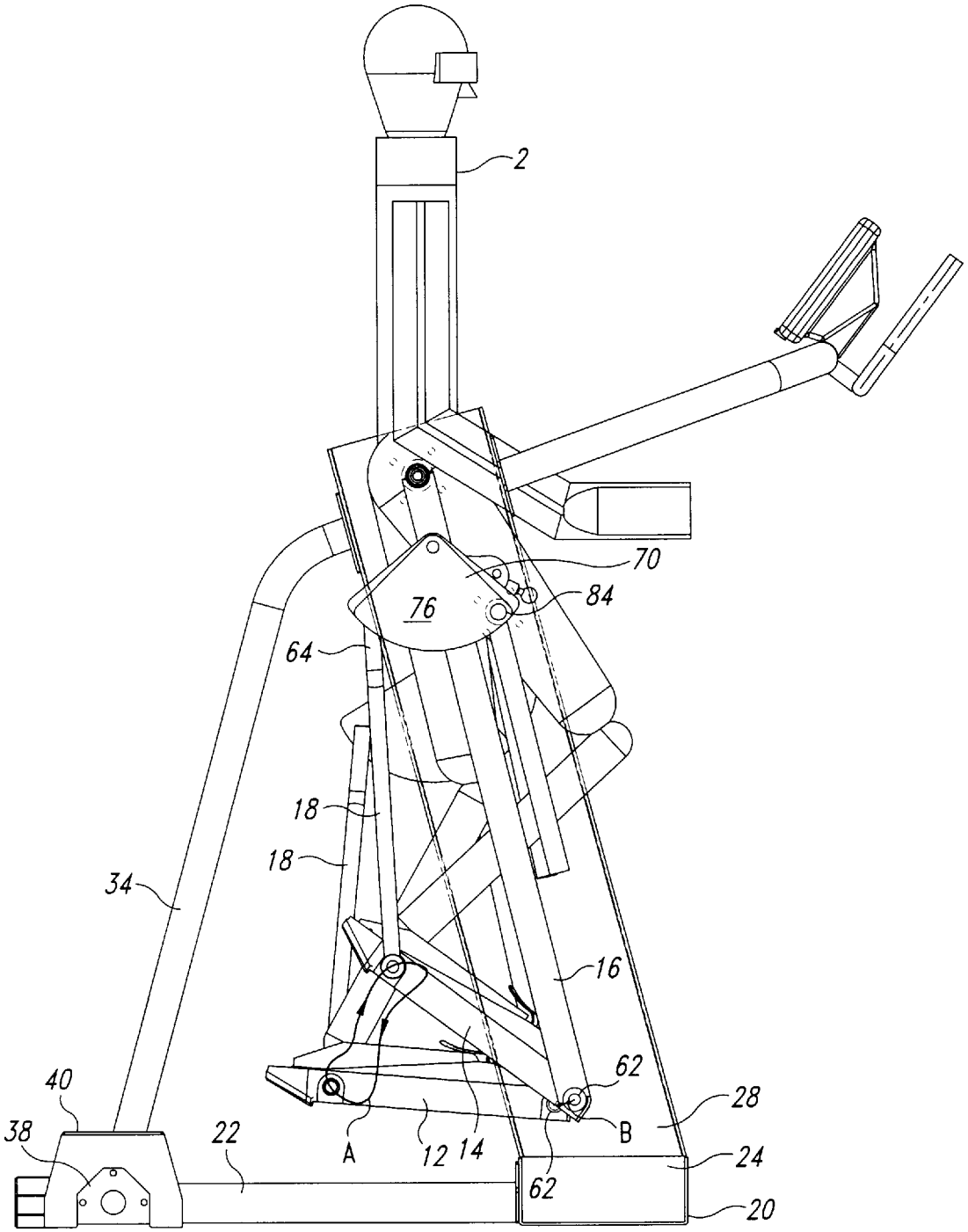
FIG. 9 is a right side schematic elevational view of the exercise apparatus of FIG. 1 showing the user exercising with a stepping motion having primarily stride height with little stride length and illustrating the rearward pedal pivot and forward pedal pivot travel loops.

In FIG. 9, the user is shown exercising with a striding motion which simulates stepping in place with very little stride length, but a significant stride height. This produces a relatively closed heel travel path A for the heel travel of the user's feet and the longitudinal axis of the path is upwardly oriented. It is noted that if the user simulated stepping in place with no stride length, i.e., without the user's feet moving forward or rearward at all, the heel travel path A would be an arcuate line extending generally upward. The amount the user lifts his heels relative to his toes during an exercise repetition determines the end limits of travel of the heel travel path A. More heel lift will produce a longer heel travel path A and less heel lift will produce a short heel travel path A.

Referring again to FIG. 4, the path of travel of the right and left pedals 12 and 14 measured at the pivot pin 62, located generally forward of the toe portion of the user's foot, at the pivot attachment point of the swing arm 16 to the corresponding right and left pedals 12 and 14, is shown as a closed, arcuate linear path B. Travel path B is simply an arc of a circle having a radius determined by the distance between the shaft 56 where the swing arm is pivotally attached to the corresponding right and left side support frame members 28 and 30 and the pivot pin 62 where the swing arm is pivotally attached to the corresponding right and left pedals. The travel path B extends between the rearward and forward most positions of the right and left foot pedals 12 and 14 and corresponds to the stride length being used for the exercise repetition. The length of travel path B can be changed at any time during an exercise simply by the user changing to a shorter or longer stride length. The forward end portion 60 of the right and left foot pedals 12 and 14, and the pivot pin 62 joining them to the right and left swivel arms 16 move with a simple reciprocating arcuate movement along the travel path B, with the rearward and forward travel tracing out overlapping rearward and forward movement segments of the path.

Figure 6:
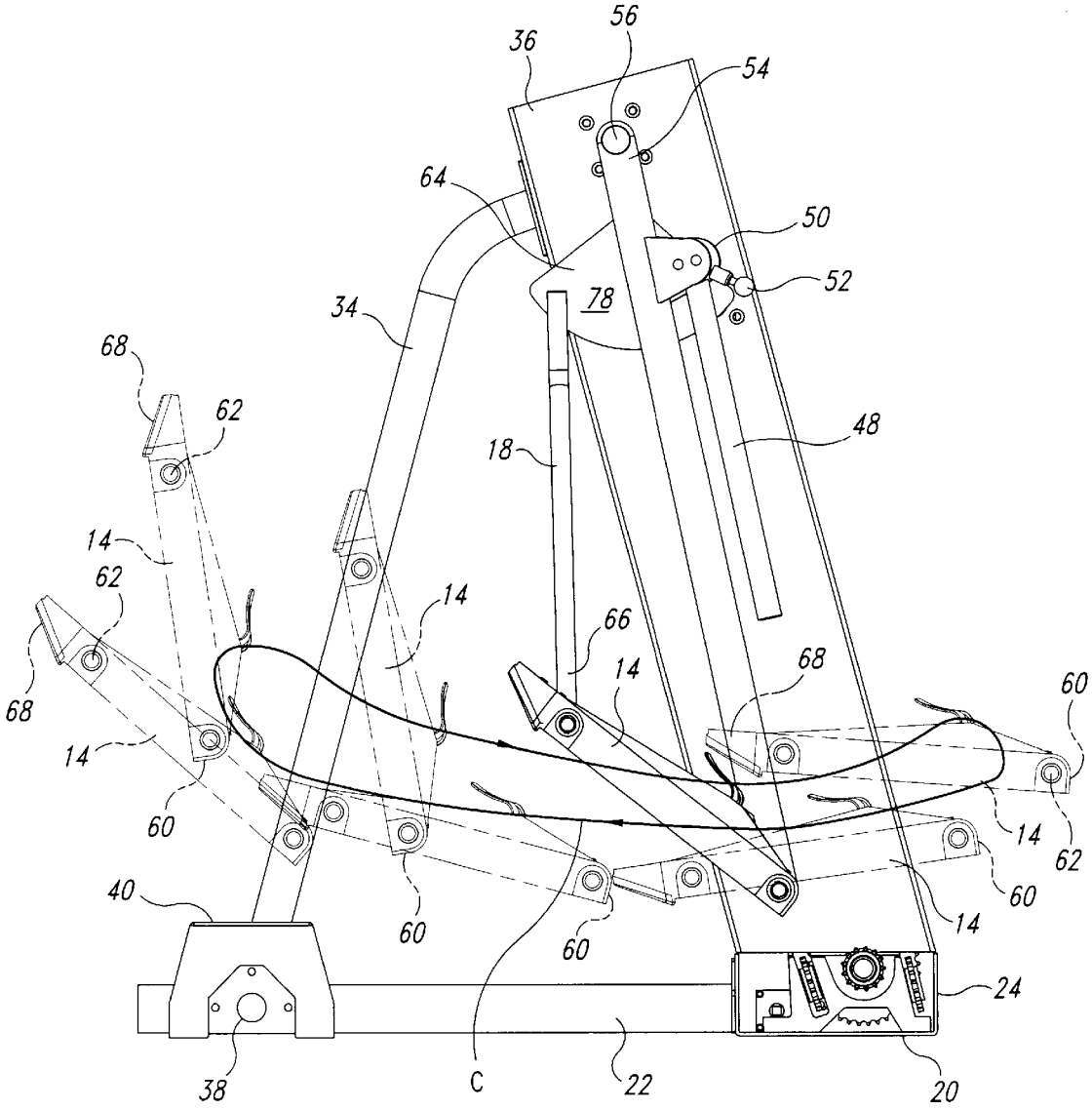
FIG. 6 is another fragmentary, right side schematic elevational view of the left side pedal assembly in the same positions as shown in FIG. 5, showing the same running length stride but showing a travel loop for the toe portion of the user's foot.

The feet 4 and 6 of the user 2 on the right and left pedals 12 and 14 have the forward or toe end portion thereof positioned in the corresponding toe clip 82 against the foot stops 81, located rearward of the pivot pin 62, at which the swing arms 16 are pivotally attached to the pedals. As such, the toe portion of the user's foot experiences a path of travel with an ovate open travel loop for an exercise repetition. The travel path is indicated in FIG. 6 by reference letter C. The travel path C has a much more closed loop than the heel travel path A. The somewhat open travel path C provides a more natural stride height for the toe portion of the user's foot than would occur had the foot stops 81 and the toe clips 82 been placed over the pivot pins 62 where the toe portion would travel along travel path B. If desired, the foot stops 81 and toe clips 62 may be moved closer to the pivot pin 62 to reduce the toe stride height or further rearward to increase the toe stride height. The location illustrated is approximately four inches rearward of the pivot pin 62.

The rearward and forward extents between which the right and left pedals 12 and 14 travel along the travel path B during an exercise repetition depend upon the stride length used by the user 2. That length can be infinitely varied by the user at any time during the exercise. As previously noted, the leg swinging motion illustrated in FIG. 7 has substantially the same stride length as the running motion illustrated in FIG. 4. The stride length of the jogging motion shown in FIG. 8 has a much shorter travel path B, and the stepping in place motion shown in FIG. 9 has almost no stride length.

Returning now to the description of the construction of the apparatus 10, FIG. 10 shows the apparatus with the covers 32 removed from the right and left side support frame member 28 and 30 and the cover 26 removed from the forward base frame member 24. The interior of the right and left side support frame member 28 and 30 and the interior of the forward base frame member 24 serve as compartments within which many of the moving components of the apparatus 10 are located to keep them away from the user 2 while exercising. This includes heel lift interconnect system components, stride length interconnect system components, and at least a portion of resistance mechanism components, as will be described below. The operation of these components is described with reference primarily to FIGS. 10-19.

As previously noted, the lower end portions 58 of the right and left swing arms 16 are pivotally attached to the forward end portion 60 of the corresponding right and left pedals 12 and 14 by the pivot pin 62. The right and left swing arms 16 support the corresponding right and left pedals 12 and 14 for downward and upward pivotal movement of the rearward end portion 68 of each pedal relative to the forward end portion 60 thereof in user variable downward and upward amounts during an exercise. The variable downward amount of the downward movement of the rearward end portion 68 of each of the right and left pedals 12 and 14 corresponds to the amount of downward movement of the heel portion of the user's foot on the rearward end portion of the pedal applied by the user during the exercise. The range of downward and upward movement of the rearward end portion 68 of the right and left foot pedals 12 and 14, and hence the stride height range achievable using the apparatus 10, is in part determined by the location at which the pivot pin 80 attaches the right and left lift arms 18 to the pedals, and also by the lengths and angular orientations of the lift arms 18 and the pivot links 70 by which the lift arms are pivotally attached to the right and left side support frame members 28 and 30.

Figure 10A:
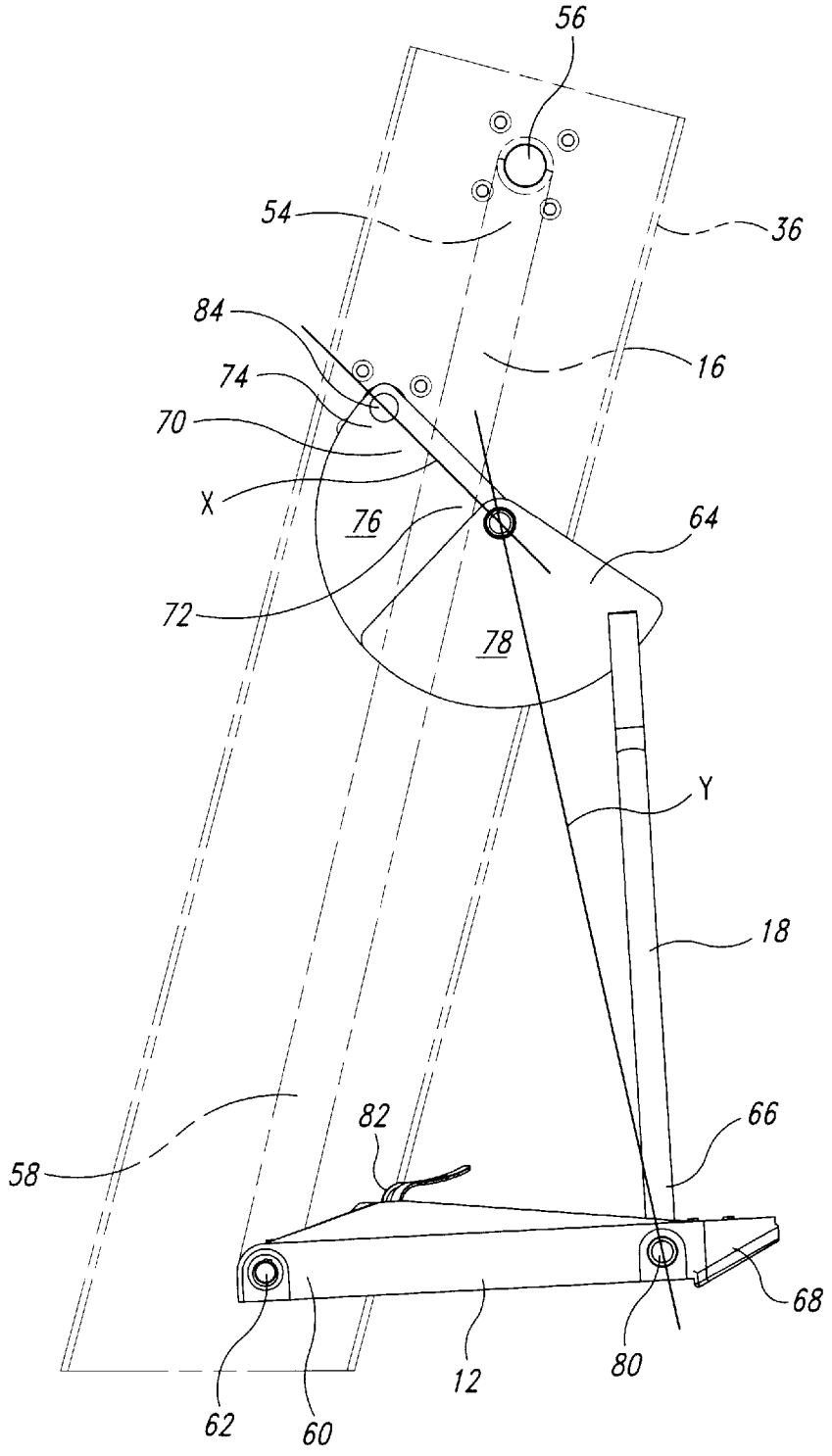
FIG. 10A is a left side elevational view of a right side pedal assembly as shown in FIG. 3, with the pedal rotated downward.
Figure 11:
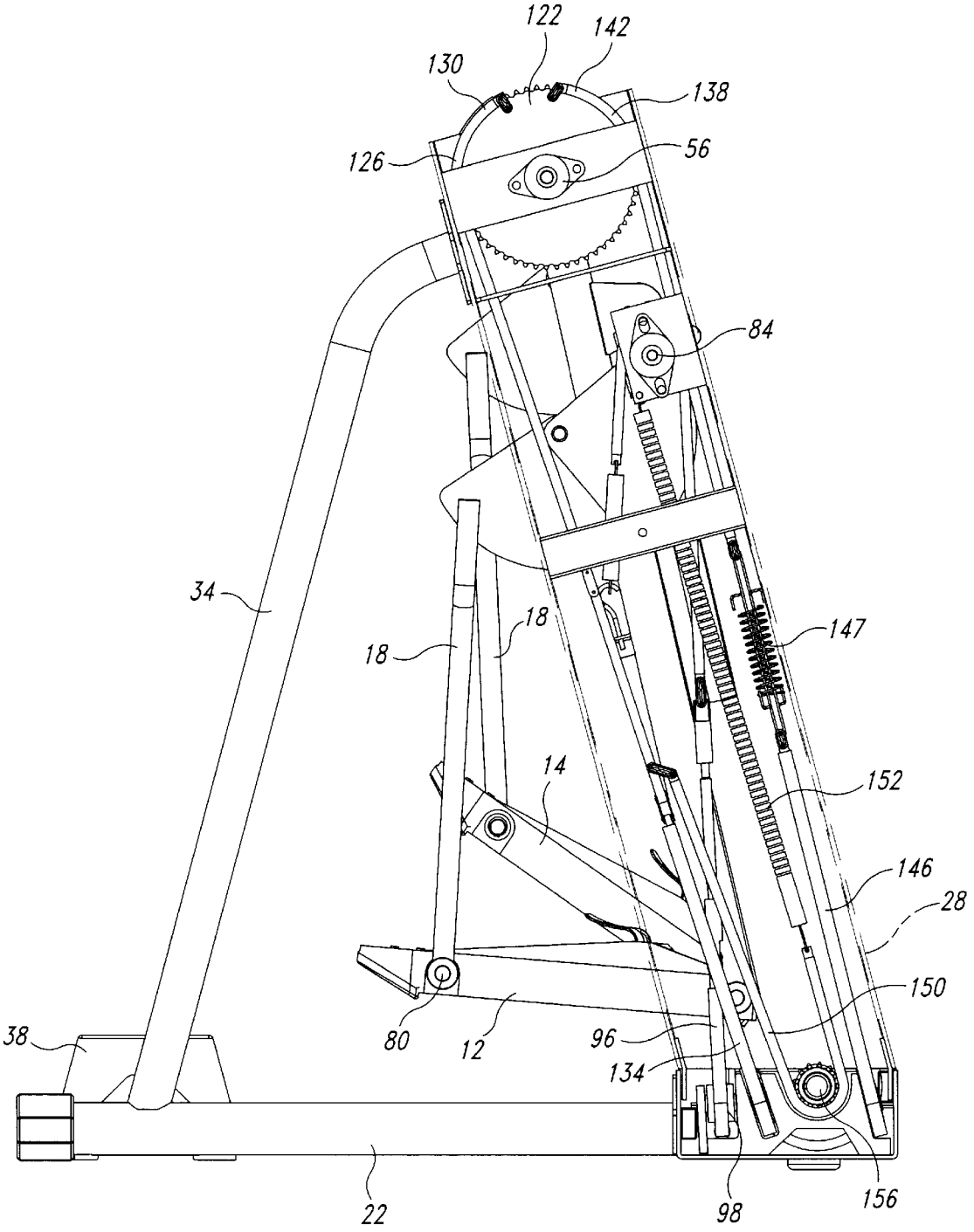
FIG. 11 is a right side elevational view of the exercise apparatus as shown in FIG. 10.
Figure 12:
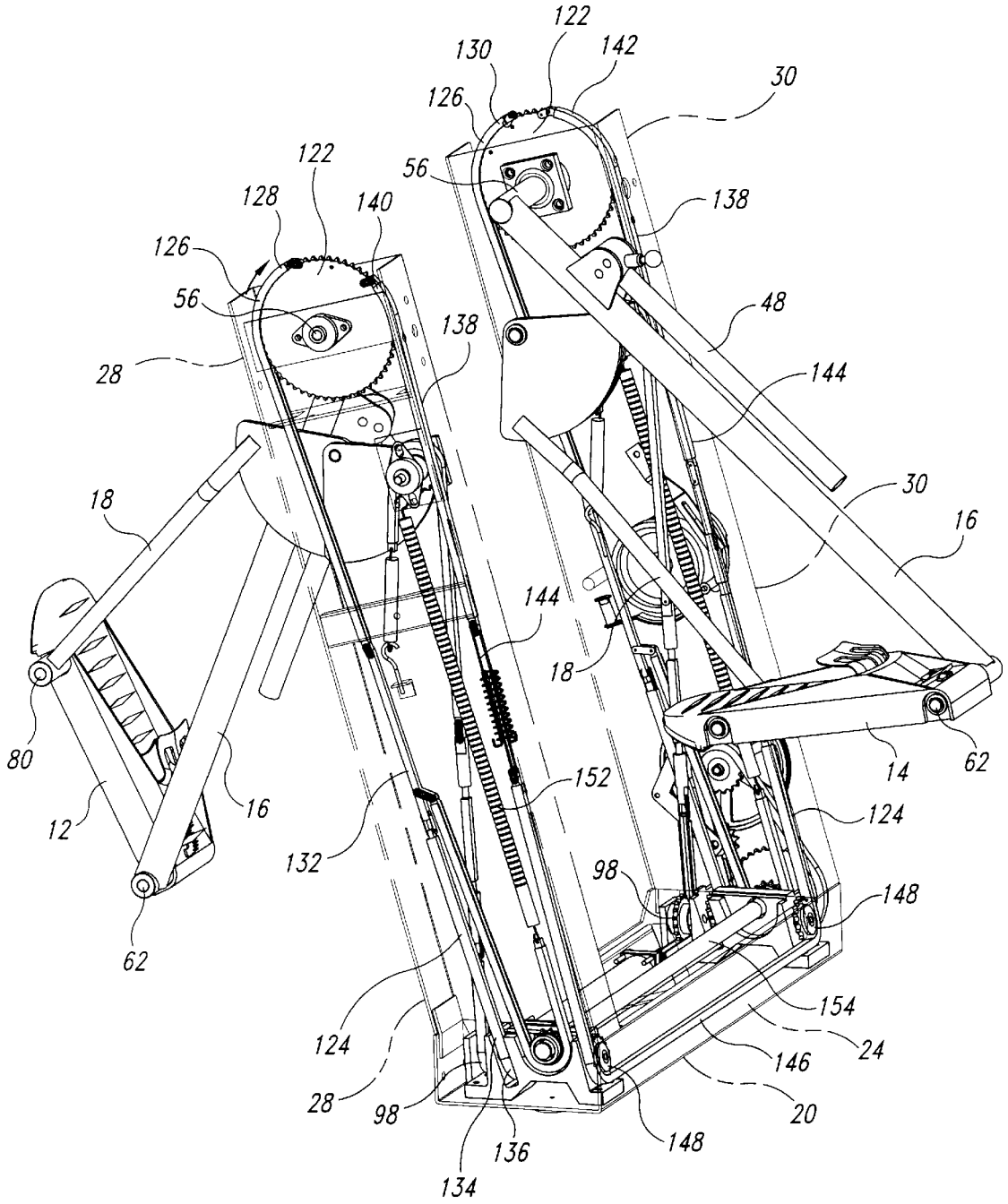
FIG. 12 is a front, right side isometric view of the exercise apparatus of FIG. 1, illustrating the drive system without illustrating the frame except for the right and left side support frames shown in phantom line, with right and left swing arms and pedals substantially fully extended.
Figure 14:
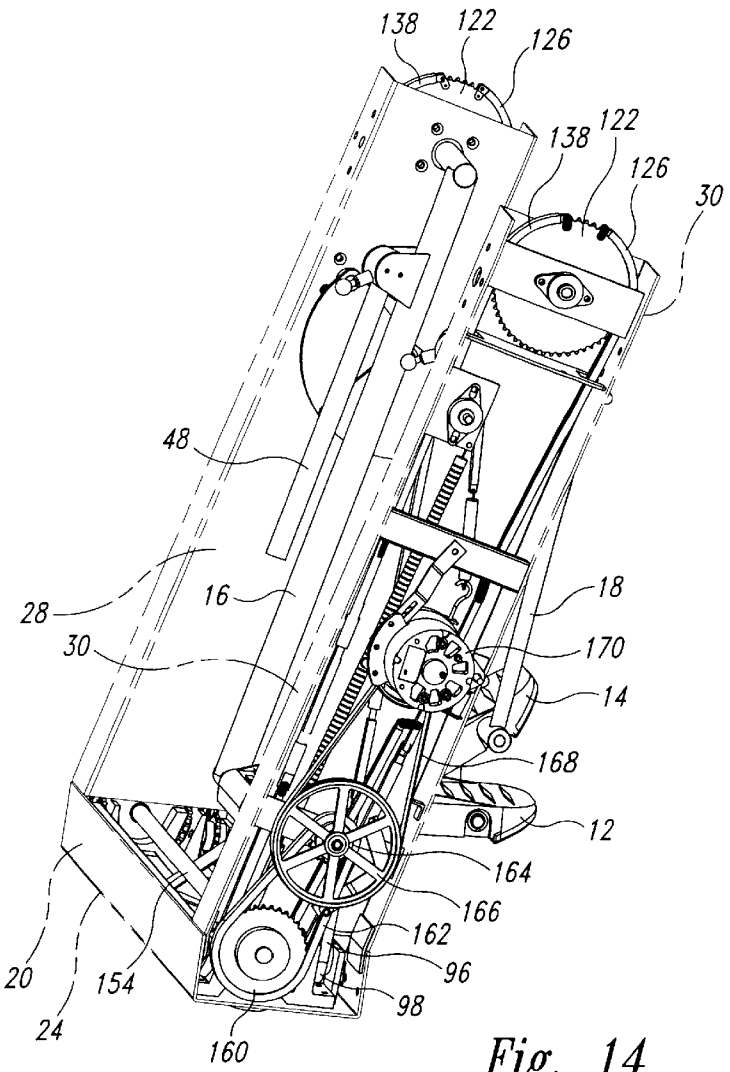
FIG. 14 is a front, left side isometric view of the exercise apparatus as shown in FIG. 12, illustrating a resistance mechanism used to resist the swinging motion of the right and left swing arms.
Figure 13:
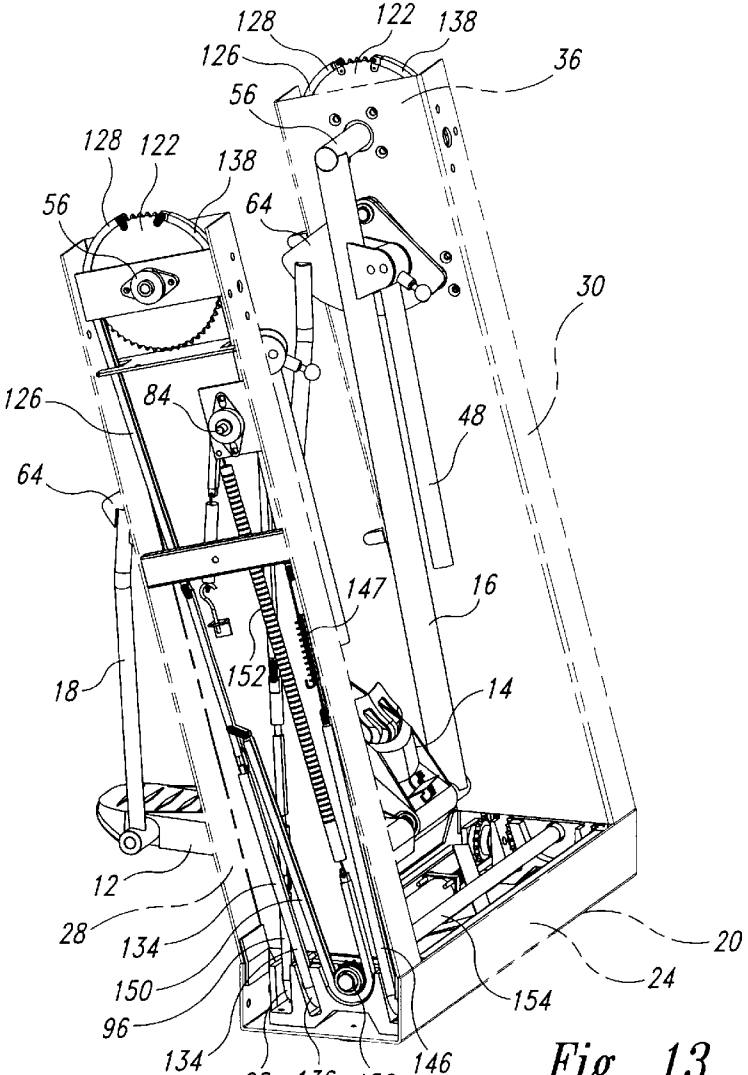
FIG. 13 is a front, right side isometric view of the exercise apparatus as shown in FIG. 12, with the right and left swing arms in a neutral rest position.

The lower limit of travel of the rearward end portion 68 of the right and left pedals 12 and 14 when a user of sufficient body weight stands on the pedals is reached when an imaginary line, indicated by reference letter X in FIG. 10A, extending between the point of pivotal attachment of the second end portion 74 of the pivot link 70 to the corresponding one of the right and left side support frame members 28 and 30, and the point of pivotal attachment of the first end portion 72 of the pivot link 70 to the upper end portion 64 of the corresponding lift arm 18, is in straight line arrangement with an imaginary line, indicated by reference letter Y in FIG. 10A, extending between the point of pivotal attachment of the upper end portion 64 of the lift arm 18 to the first end portion 72 of the pivot link 70 to the point of pivotal attachment (i.e., the pivot pin 80) of the lower end portion 66 of the lift arm 18 to the corresponding right and left pedal 12 and 14. When the lift arm and pivot link mechanical linkages are in this position, the effective lever arms are in straight line arrangements and no further downward rotation of the pedal about the pivot pin 62 pivotally attaching the forward end portion 60 of the pedal to the lower end portion 54 of the swing arm 16 is possible. As will be described below, the apparatus 10 is designed such that no users will have sufficient body weight to cause the lift linkages to reach the described limit. The typical end position of the lift linkages under the weight of a user is similar to that shown in FIG. 10A.

First, however, it is necessary to understand the interconnection of the right and left lift arms 18 to produce dependent downward and upward motion of the right and left pedals 12 and 14. As most clearly illustrated in FIG. 16, the second end portion 74 of the pivot link 70 connecting the corresponding right and left lift arm 18 to the corresponding right and left side support frame members 28 and 30 is pivotally attached by a gear shaft 84 to the corresponding right or left side support frame member 28 or 30 using bearings. The gear shaft 84 carries an upper sprocket 86 fixedly attached thereto for rotation with the shaft and on which a flexible chain segment 88 is entrained. A rearward end of the chain segment 88 is connected by a tensioning spring 90 to the corresponding one of the right and left side support frame member 28 or 30 by an attachment member 92. The forward ends of the chain segments 88 entrained on the right and left side upper sprockets 86 are connected together through a series of components which will now be described. In particular, the forward end of the chain segment 88 is attached through a 90° turn master link 94 to an upper end of a flexible chain segment 96 which has its links oriented at 90° relative to the links of the chain segment 88. The chain segment 96 passes around a lower idler sprocket 98 and has a lower end attached to a corresponding one of right and left ends 100 and 102 of a bar 104 of a spring assembly 106 shown in FIGS. 17–19. The spring assembly 106 serves to cushion the end portion of the downward travel of the rearward end portion 68 of the right and left pedals 12 and 14, and also serves to limit the end travel thereof since no user has sufficient body weight to drive the pedal to its lowest possible travel defined by the lift linkages described above.

Figure 19:
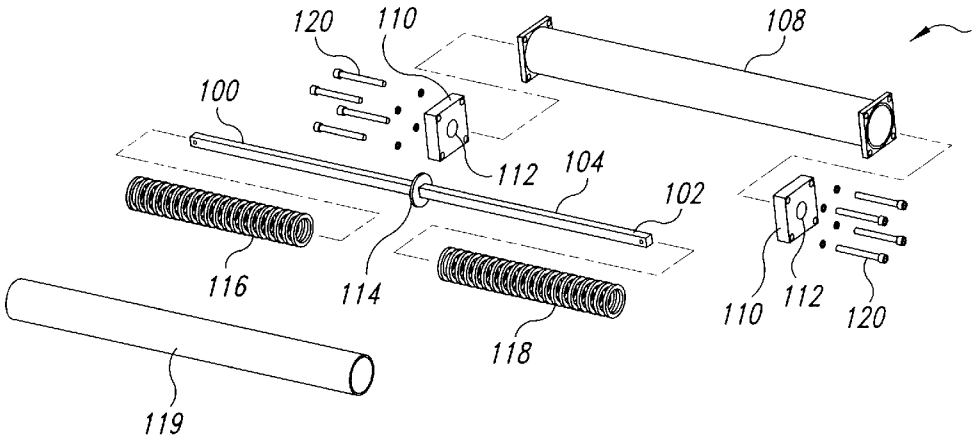
FIG. 19 is an isometric view of the disassembled heel lift spring assembly shown in FIG. 17.
Figure 18:
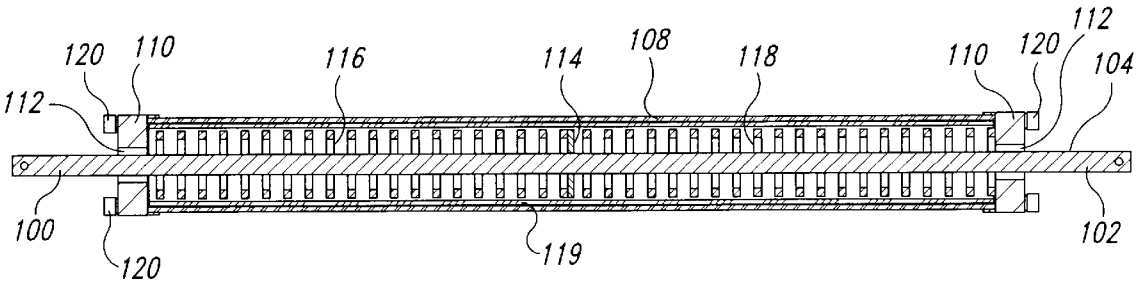
FIG. 18 is a longitudinal cross-sectional view of the heel lift spring assembly of FIG. 17 taken substantially along line 18-18 thereof.
Figure 17:
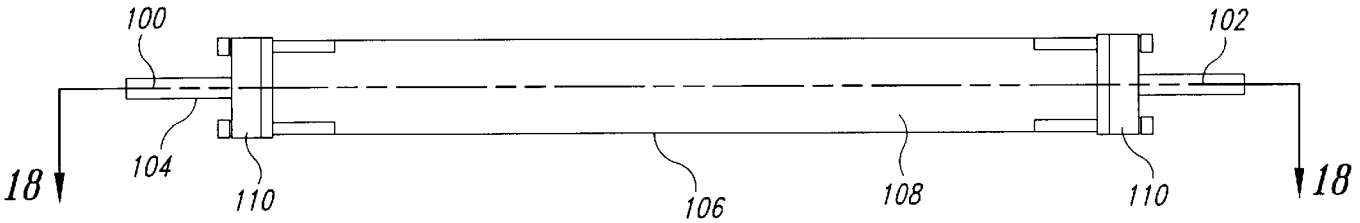
FIG. 17 is an enlarged, front elevational view of a heel lift spring assembly of the exercise apparatus of FIG. 1.

As illustrated in FIGS. 17–19, the spring assembly 106 includes a tubular body 108 having right and left fixedly attached end caps 110, each having a central aperture 112 therein. The bar 104 is positioned within the tubular body 108 and has its right end 100 projecting through the aperture 112 in the end cap 110 fixedly attached to the right end of the tubular body 108 and the left end 102 projecting through the central aperture of the end cap fixedly attached to the left end of the tubular body. The bar 104 has a spring engaging disk 114 welded thereto at its longitudinal center, and a right spring 116 is concentrically mounted on the bar between the disk 114 and the right end 100 of the bar and a left spring 118 is concentrically mounted on the bar between the disk and the left end 102 of the bar. The entire spring and bar assembly is received in a bushing tube 119 which is positioned within the tubular body 108 and protects the interior wall of the tubular body 108 from damage by the movement of the springs 116 and 118. With the bar 104 having the springs 116 and 118 mounted thereon positioned within the tubular body 108, the end caps 110 are fixedly attached to end flanges of the tubular body by a plurality of bolts 120. The assembled spring assembly 106 is fixedly attached to the frame 20 of the apparatus 10 within the base frame member 24.

In operation, when the user shifts his weight more to the right pedal 12 than the left pedal 14, the uneven weight causes a greater downward force to be applied to the lift arm 18 connected to the right pedal. That downward force is transmitted to the pivot link 70 to which the lift arm 18 is attached, resulting in its counterclockwise rotation and also the counterclockwise rotation of the gearshaft 84 connected thereto (as viewed from the right side as in FIG. 16). The upper sprocket 86 attached to the gear shaft 84 also rotates counterclockwise. This rotation transmits an upward force to the forward end of the chain segment 88 entrained on the upper sprocket 86 and to the upper end of the chain segment 96 to which it is attached. This upward force applies a rightwardly directed pulling force on the right end 100 of the bar 104 of the spring assembly 106, causing it to move toward the right side of the apparatus 10 (toward the left as seen in FIG. 18). The disk 114 fixedly attached to the bar 104 thereby engages the inward end of the right spring 116 trapped between the disk and the right side end cap 110 (on the left in FIG. 18) which serves as a spring stop, and begins to compress the right spring 116. The right spring 116 is selected with a spring constant so as to initially provide little resistance when engaged by the disk as a result of the initial downward travel of the rearward end portion 68 of the right pedal 12, but to progressively resist the downward movement and to totally counteract the downward movement for a user of normal body weight before the downward movement is limited by the lift linkages described above. As such, the right spring 116 serves not only to cushion the downward travel of the rearward end portion 68 of the right pedal 12 as it travels downward, but it also helps establish the end limit of downward travel. The right spring 116 serves to limit downward travel for users in conjunction with the lift linkages because as the rearward end portion 68 of the right pedal 12 moves downward, the effective lever arms of the lift arm 18 and the pivot link 70 start to approach a straight line arrangement, thereby progressively reducing the effective leverage or lever advantage and thereby transmitting progressively less of the body weight of the user to the spring assembly 106 until the transmitted force is sufficiently low to be fully counteracted by the right spring 116.

It is noted that while not a primary function, the right spring 116 will also apply a sufficient upwardly directed return force on the rearward end portion 68 of the right pedal 12 back through the chain segments 88 and 96 and the lift arm 18 so as to lift the rearward end portion of the right pedal in the event the user steps off of the right and left pedals. This will return the pedals to a neutral position with both the right and left pedals being at about the same angle. While the operation of the spring assembly 106 has been described with respect to a downward force being applied to the right pedal 12, the spring assembly operates in the same manner using the left spring 118 when the user shifts his weight more to the left pedal 14.

In the illustrated embodiment, the right and left springs 116 and 118 are selected with a spring constant such that they will provide the end limit of downward travel for an adult user of average body weight and greater, rather than the lift linkage. Further, the spring assembly 106 is designed to provide enough travel of the disk 114 within the tubular body 108 to sufficiently compress the right and left springs 116 and 118 a greater amount than will actually be experienced if a user of average body weight uses the apparatus 10.

The heel lift interconnect system components and heel lift spring assembly components just described also serve the function of interconnecting the right and left lift arms 18 to provide dependent downward and upward movement of the lift arms. The force applied to the bar 104 of the spring assembly 106 to move it toward the right side as a result of the user shifting his weight to the right pedal 12, is also transmitted via the movement of the left end 102 of the bar 104 to the chain segment 96 and the chain segment 88 on the left side so as to apply a clockwise rotational force (as viewed from the right side as in FIG. 16) on the upper sprocket 86 mounted to the left side support frame 30. This clockwise rotational movement is transmitted through the right side pivot link 70 and the right side lift arm 18 to the rearward end portion 68 of the right pedal 14 to cause the rearward end portion thereof to move upward. As such, the right and left pedals 12 and 14 move with dependent motion with the downward movement of one resulting in the upward movement of the other. It is noted that the upward movement of a pedal will not push the other pedal downward, however, in normal operation the user of the apparatus 10 would not apply an upward force with his feet by them standing on the pedals. It is noted, however, that in an alternative embodiment not illustrated, the right and left pedals are not limited to a dependent downward and upward movement in one direction, and are interconnected such that upward pulling movement of one pedal is transmitted into a downward force applied to the other pedal. In yet another alternative embodiment not illustrated, the downward and upward movements of the rearward end portions of the right and left pedals are not dependent.

From the description of the apparatus 10 provided, it will be understood that the right and left lift arms 18 are interconnected by interconnection members such that in response to downward movement of the rearward end portion 68 of either one of the right or left pedals 12 or 14 corresponding to downward movement of the rearward end portion of the user's foot on the pedal applied by the user during the exercise, will result in a lifting force being applied on the opposite side lift arm to lift the rearward end portion of the opposite side pedal upward with a variable upward movement amount corresponding to the variable downward movement amount of the pedal to which the user has shifted his weight. Thus, no matter how far the user forces down the rearward end portion 68 of one pedal, a corresponding upward travel of the opposite side pedal results. Further, the amount of downward movement of the pedal is simply responsive to the downward movement of the user's foot on the pedal without restricting the movement to a manufacturer-defined travel length, and the downward travel, and hence the upward travel of the opposite pedal, is determined by the downward travel the user wishes to experience before shifting his weight to the opposite pedal and beginning downward movement of that pedal.

The apparatus 10 further includes stride length interconnect system components and resistance mechanism components. The apparatus 10 utilizes not only dependent downward and upward movement of the right and left pedals 12 and 14, but also dependent rearward and forward movement of the right and left swing arms 16 and hence the right and left pedals. As best illustrated in FIGS. 11–15, the shaft 56 to which the upper end portion 54 of the right and left swing arms 16 are fixedly attached is itself rotatably mounted by bearings to the corresponding right and left side support frame members 28 and 30. The shaft 56 has a gear 122 fixedly attached thereto for rotation with the shaft. A segmented chain assembly 124 includes a pair of flexible chain segments 126. The right side chain segment 126 has an upper end portion 128 entrained on a rearward side of the right side gear 122 and an end link fixedly attached to the gear. The left side chain segment 126 has an upper end portion 130 entrained on a rearward side of the left side gear 122 and an end link fixedly attached to the gear. The chain segments 126 each extend downward from the corresponding gear 122 with a lower end thereof connected to an upper end of a corresponding one of right and left side bars 132. A flexible chain segment 134 has its opposite ends attached to a lower end of each of the bars 132 and extends around right and left side idler sprockets 136 positioned within the base frame member 24.

Figure 15:
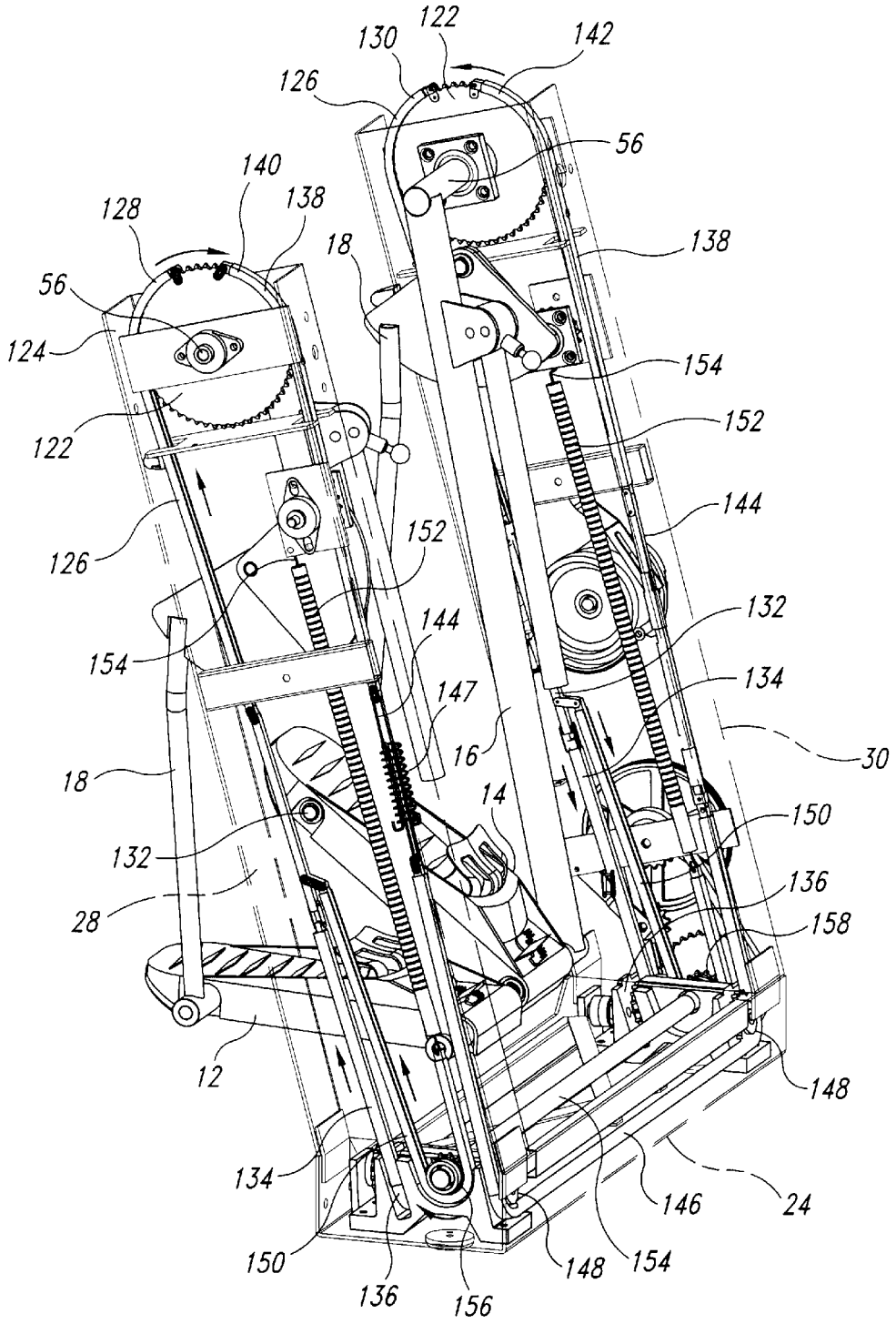
FIG. 15 is a front, right side isometric view of the exercise apparatus as shown in FIG. 12, with the heel lift interconnect system components removed.
Figure 16:
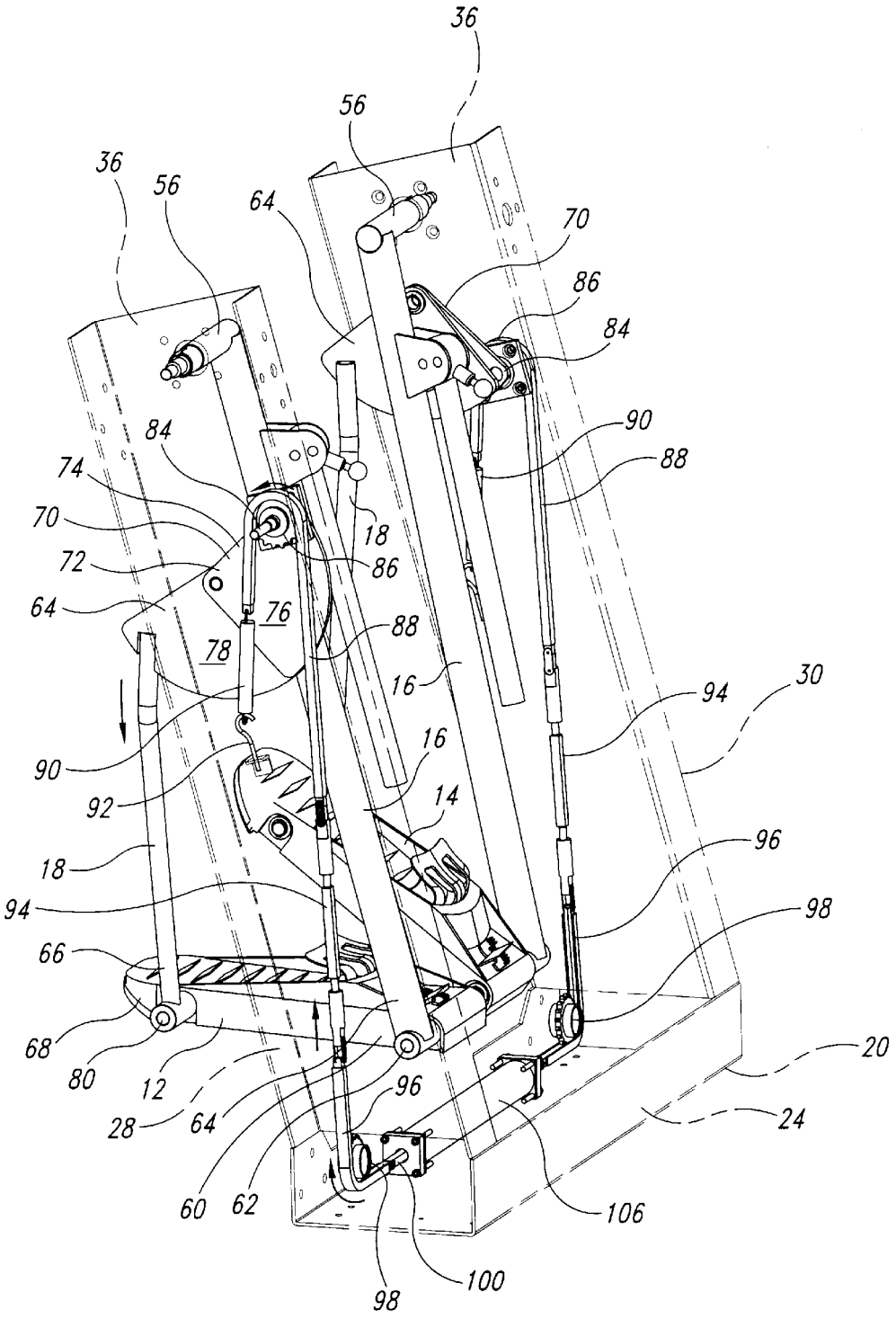
FIG. 16 is a front, right side isometric view of the exercise apparatus as shown in FIG. 12, with the stride length interconnect system components and the resistance mechanism removed.

The segmented chain assembly 124 also includes a pair of flexible chain segments 138. A right side chain segment 138 has an upper end portion 140 entrained on a forward side of the right side gear 122 and an end link fixedly attached to the gear. The left side chain segment 138 has an upper end portion 142 entrained on a forward side of the left side gear 122 and an end link fixedly attached to the gear. The chain segments 138 each extend downward from the corresponding gear 122 with a lower end thereof connected to an upper end of a corresponding one of right and left side bar links 144. The right side bar link 144 is connected to the chain segment 146 through a spring 147. A lower end of each of the bar links 144 is attached to an opposite end of a flexible chain segment 146 which extends between the right and left side bar links and is entrained on idler pulleys 148 positioned in the base frame member 124, as best shown in FIG. 15. The right side bar link 144 is connected to the chain segment 146 through a spring 147.

The segmented chain assembly 124 acts much like a continuous chain loop interconnecting the gears 122 of the right and left swing arms 16. As a result, in response to variable amounts of rearward movement of the right pedal 12 corresponding to the amount of rearward movement of the user's right foot during an exercise, the right side gear 122 is caused to rotate clockwise (as viewed from the right side as in FIG. 15) and transmits an upward force on the right side chain segment 126 which is transmitted through the right side bar 132 and the chain segment 134 to the left side bar 132 and the left side chain segment 126 as a downward force. This downward force is transmitted to the left side gear 122 as a counterclockwise force (as seen in FIG. 15) which rotates the left swing arm 16 counterclockwise and moves the left pedal 14 attached thereto forward in an amount corresponding to the amount of the variable rearward movement of the right pedal 12. The reverse occurs when the user moves the left pedal 14 rearward and results in a variable amount of forward movement of the right pedal 12 corresponding to the amount of rearward movement of the left pedal 14. The segmented chain assembly 124 thus interconnects the right and left swing arms 116 and causes rearward movement of one to produce forward movement of the other to provide the dependent right and left side motion of the right and left side swing arms 16 and the right and left side pedals 12 and 14 attached thereto. It is noted that with the segmented chain assembly 124 described, the dependency is actually in both directions in that if a user applies a forward force to one of the pedals, the opposite pedal will move rearward, but such forces will not usually be encountered during a normal exercise using the apparatus 10. It does, however, help in returning the pedals to a neutral position when not standing on them.

The apparatus 10 has been described as having dependent downward and upward pedal lift between the right and left sides to produce dependent stride height movement, and dependent rearward and forward pedal movement between the right and left sides to produce dependent stride length action. However, the heel lift interconnect system components and the stride length interconnect components are operatively disconnected from each other such that movement of the right and left pedals 12 and 14 and the swing arms 18 in the rearward or forward direction will not produce a prescribed downward or upward movement of the rearward end portions 68 of the right and left pedals relative to their forward end portions 60. The reverse is also true, in that downward or upward movement of the rearward end portion 68 relative to the forward end portion 60 of the pedals 12 and 14 will not necessarily produce rearward or forward movement of the right and left pedals 12 and 14 or the swing arms 16. Thus, while the apparatus 10 provides for right and left dependent pedal stride length movements and user variable stride lengths in response to the particular stride length used by the user, and right and left dependent pedal stride height movements and user variable stride heights in response to the stride height used by the user, the stride length of the pedals and the stride height of the pedals are independent of each other and may be varied in independent amounts. The result is an extremely flexible exercise apparatus that produces a very good and natural feeling exercise allowing the user to use his natural stride length and stride height, and vary both independently and as desired during an exercise without requiring equipment setting changes.

So as to allow the user to control the energy expended during an exercise using the apparatus 10, a resistance device is operatively connected to the right and left swing arms 16 and hence the right and left pedals 12 and 14 to resist rearward movements thereof. The resistance device is controlled by the user through the control panel 44 to require the user of the apparatus to perform a desired amount work while exercising.

Still with reference to FIGS. 11–15, the rearward movement of the right and left pedals 12 and 14 and the corresponding right and left swing arms 16 is transmitted to the resistance device by a pair of flexible chain segments 150, each having one end attached to a lower end of the corresponding one of the right and left bars 132. The other end thereof is connected to a tensioning spring 152 which has an end 154 fixedly attached to a corresponding one of the right and left side support frame members 28 and 30. A transverse drive shaft 154 is rotatably supported by bearings in the base frame member 24 and extends laterally between the right and left side support frame members 28 and 30 within the base frame member 24. A right side end portion of the drive shaft 154 has a one-way clutch bearing 156 mounted thereon and a left side end portion of the drive shaft has a one-way clutch bearing 158 mounted thereon. The right side chain segment 150 is entrained on the right side one-way clutch bearing 156 and the left side chain segment 150 is entrained on the left side one-way clutch bearing 158.

The right and left side one-way clutch bearings 156 and 158 are arranged such that clockwise rotation thereof (as viewed from the right side as shown in FIG. 15) transmits rotary drive to the drive shaft 154 to rotate it in the clockwise direction. As previously described, when the right pedal 12 is moved rearward, the resulting clockwise rotation of the right side gear 122 applies an upward force on the right side bar 132. Since the right side chain segment 150 has its end connected to the right side bars 132, the upward force is also applied thereto which turns the right side one-way clutch bearing 156 clockwise and transmits a clockwise rotational drive force to the drive shaft 154. As previously described, this same motion transmits a downward force to the left side bar 132 and thus a downward force on the left side chain segment 152 entrained on the left side one-way clutch bearing 158. As viewed from the right side, this produces a counterclockwise force on the left side one-way clutch bearing 158, primarily through the left side tensioning spring 152 taking up the slack in the left side chain segment 150 as the left side bar 132 moves downward. The counterclockwise force applied to the left side one-way clutch bearing 158 causes it to turn freely in the counterclockwise direction without any counterclockwise rotational drive force being applied to the drive shaft 154. Thus, the only rotational drive experienced by the drive shaft 154 will be the clockwise rotational drive of the right side one-way clutch bearing 156.

When the left pedal 14 is moved rearward, the operation described above is reversed with the left side one-way clutch bearing 158 providing a clockwise rotational drive force to the drive shaft 154 and the right side one-way clutch bearing 156 overrunning and providing no rotational drive to the drive shaft. As such, the rearward movements of the right and left pedals 12 and 14 are summed by the drive shaft 154 into clockwise rotational movement of the drive shaft.

As best shown in 14, the drive shaft 154 has a drive gear 160 fixedly attached to a left end thereof for rotation with the drive shaft. A continuous loop chain 162 is entrained on the drive gear 160 and a smaller diameter gear 164. The smaller diameter gear 164 is mounted for rotation on a common rotational axis with a larger diameter pulley 166 for rotation therewith. The gear 164 and pulley 166 are rotatably supported by the left side support frame member 30. A drive belt 168 is entrained on the pulley 166 and a drive pulley of an alternator 170 having a smaller diameter than the pulley 166. The alternator is supported by the left side support frame member 30.

With the described arrangement of the large drive gear 160 turning a smaller diameter gear 164, which turns the large diameter pulley 166, and the pulley 166 driving a smaller diameter drive pulley of the alternator 170, a speed increasing transmission results. In conventional manner, the operation of the alternator 170 is controlled by the control panel 44 and related circuitry (not shown) to provide resistance to the clockwise turning of the drive shaft that results from rearward movement of the right and left pedals 12 and 14, as described above. The control panel 44 controls the alternator 170. The alternator 170 is controlled based on wattage or workload, preferably to require a constant work at a selected work level. While an alternator and speed increasing transmission is shown as the resistance device used by the apparatus 10, other resistance devices may be used such as friction brakes and eddy current brakes.

It is noted that the primary function of the tensioning springs 152 attached to the chain segments 150 entrained on the right and left one-way clutch bearings 156 and 158 is to maintain the chain segments entrained on the sprockets of the one-way clutch bearings. However, the tensioning springs 152 also serve the function of returning the swing arms 16 and hence the right and left pedals 12 and 14 to which they are attached to a neutral center position when the user steps off of the pedals. When the right and left pedals 12 and 14 are returned to the neutral centered position, they are in good position for the user to easily step onto them by first stepping upon the step 40 forming a part of the rear base frame member 38, and then stepping up onto the pedals.

In the illustrated embodiment of the apparatus 10, the shaft 56 to which the upper end portion 54 of the right and left swing arms 16 is attached and about which the swing arms pivot is attached to the right and left side support frame members 28 and 30 at a height above the right and left pedals which positions the hip joints of the user with an average adult height standing on the right and left pedals during an exercise at about the height of the shaft 56. In the illustrated embodiment, the right and left side shafts 56 are pivotally attached to the right and left side support frame members 28 and 30 at a height above the right and left pedals 12 and 14 when they are in a neutral resting position of about 30 to 50 inches, with 40 inches being the preferred height of the shaft 56 above the corresponding pedal.

In the illustrated embodiment of the apparatus 10, a stride length of at least 12 inches is provided to accommodate a small stride length but permits the stride length to be increased to at least 36 inches for a larger stride length. In the illustrated embodiment, the stride length used may be even smaller than 12 inches, such as when performing the stepping in place motion illustrated in FIG. 9. In the illustrated embodiment of the apparatus 10, a stride height range is provided from at least 3–4 inches as a minimum range, to at least 9–11 inches as a maximum range. While the apparatus could be constructed to provide other stride lengths and heights, the identified ranges are believed to be appropriate to serve a variety of sized users, and to accommodate the average adult height user.

An exercise apparatus 200 comprising an alternative embodiment of the apparatus 10 described above is shown in FIGS. 21–22. While having a simpler and less expensive construction, the basic operation of the apparatus 200 is very similar. As with the apparatus 10, the alternative embodiment apparatus 200 includes right and left pedals 212 and 214, respectively, each pivotally attached by a pivot pin 262 in cantilevered fashion to a lower end of a corresponding one of right and left swing arms 216. The apparatus 200 includes a frame having a pair of right and left forward support legs 228 and 230, respectively, which are telescoping for shipping. An upper end of each support leg 228 and 230 is pivotally attached to a corresponding one of right and left upper end portions 232 and 234, respectively, of a U-shaped rear support frame 236. The rear support frame 236 includes a ground engaging, laterally extending frame portion 238. The apparatus 20 is constructed so that the right and left support legs 228 and 230 are foldable with respect to the rear support frame 236 to provide for compact transportation and storage of the apparatus 200. Left and right latches 240 are pivotally coupled to the right and left support legs 228 and 230 and latched to the upper end portions 232 and 234 of the rear support frame 236 to maintain the support legs in proper position while the apparatus 200 is being used.

A handlebar 242 is attached to each of the right and left support legs 228 and 230 and projects forwardly therefrom for grasping by the user while exercising. The upper ends of the right and left support legs 228 and 230 each have a pair of plates 244 fixedly attached thereto with the upper end of each support leg positioned between one of the pairs of plates. The upper end portions 232 and 234 of the rear support frame 236 are also positioned between the corresponding pair of plates and pivotally attached thereto by a pivot pin 246. The right and left side pairs of plates 244 also serve to pivotally support an upper end of the right and left swing arms 216 using bearing supported shafts 248 for rearward and forward swinging movement of the right and left swing arms 216. The upper end of each of the right and left swing arms has a pulley 250 fixedly attached thereto.

The apparatus 200 does not use lift arms 18 such as used in the apparatus 10, but rather provides the lifting force to a rearward end portion 268 of the right and left pedals 212 and 214 using a pair of lift cables 270. The right side lift cable 270 has an end 272 attached to a cable clamp 274 fixedly attached to the rearward end portion 268 of the right pedal 212. The left side lift cable 270 has an end 276 attached to a left cable clamp 278 fixedly attached to the rearward end portion 268 of the left pedal 214. The right side lift cable 270 is entrained on a right side pulley 280 which are carried by the right side swing arms 216 and passes over the right side pulley 250 attached to the upper end of the right side swing arms. The left side lift cable 270 has the same arrangement.

Figure 20:
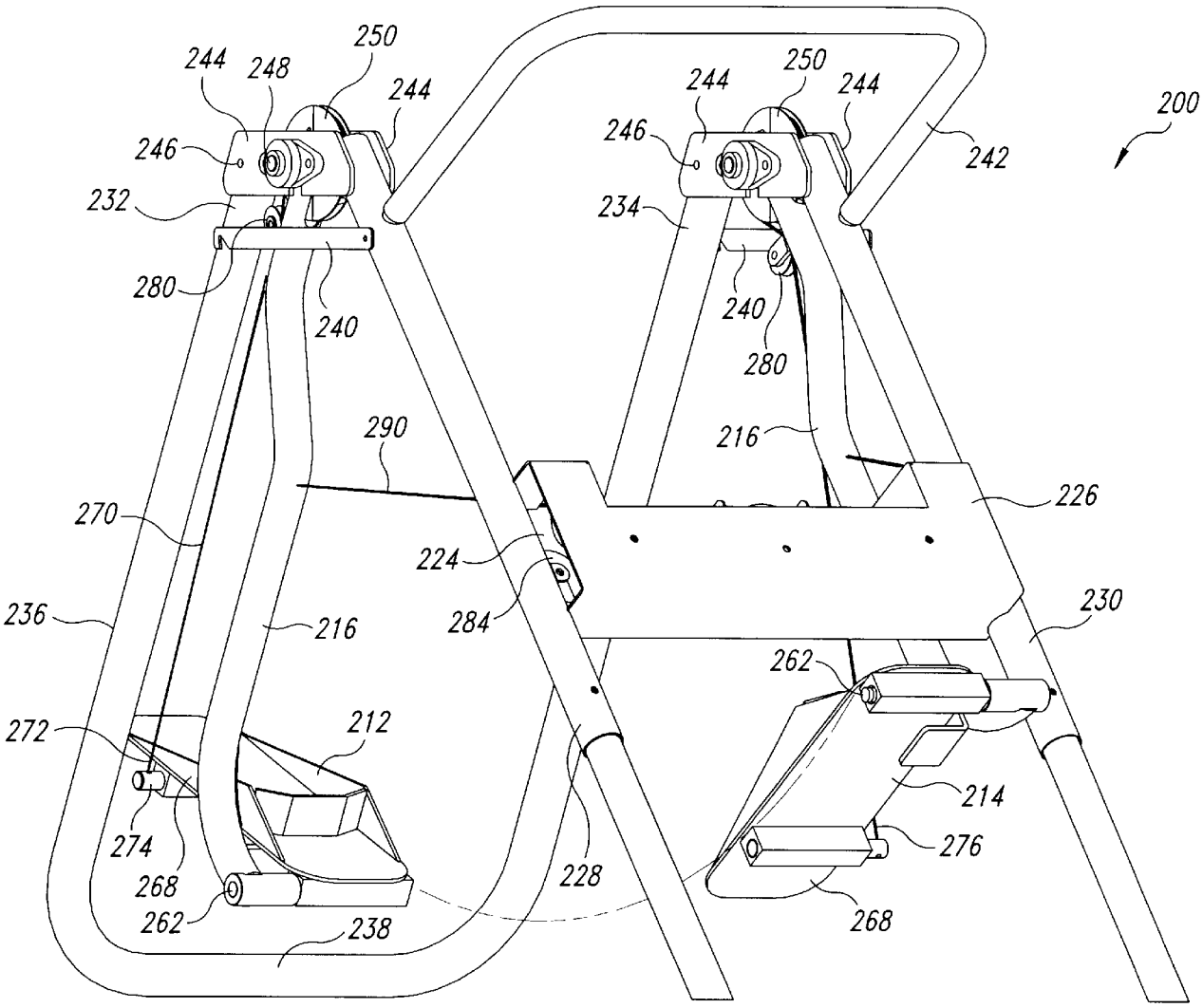
FIG. 20 is a front, right side isometric view of an alternative embodiment of the exercise apparatus of FIG. 1.
Figure 22:
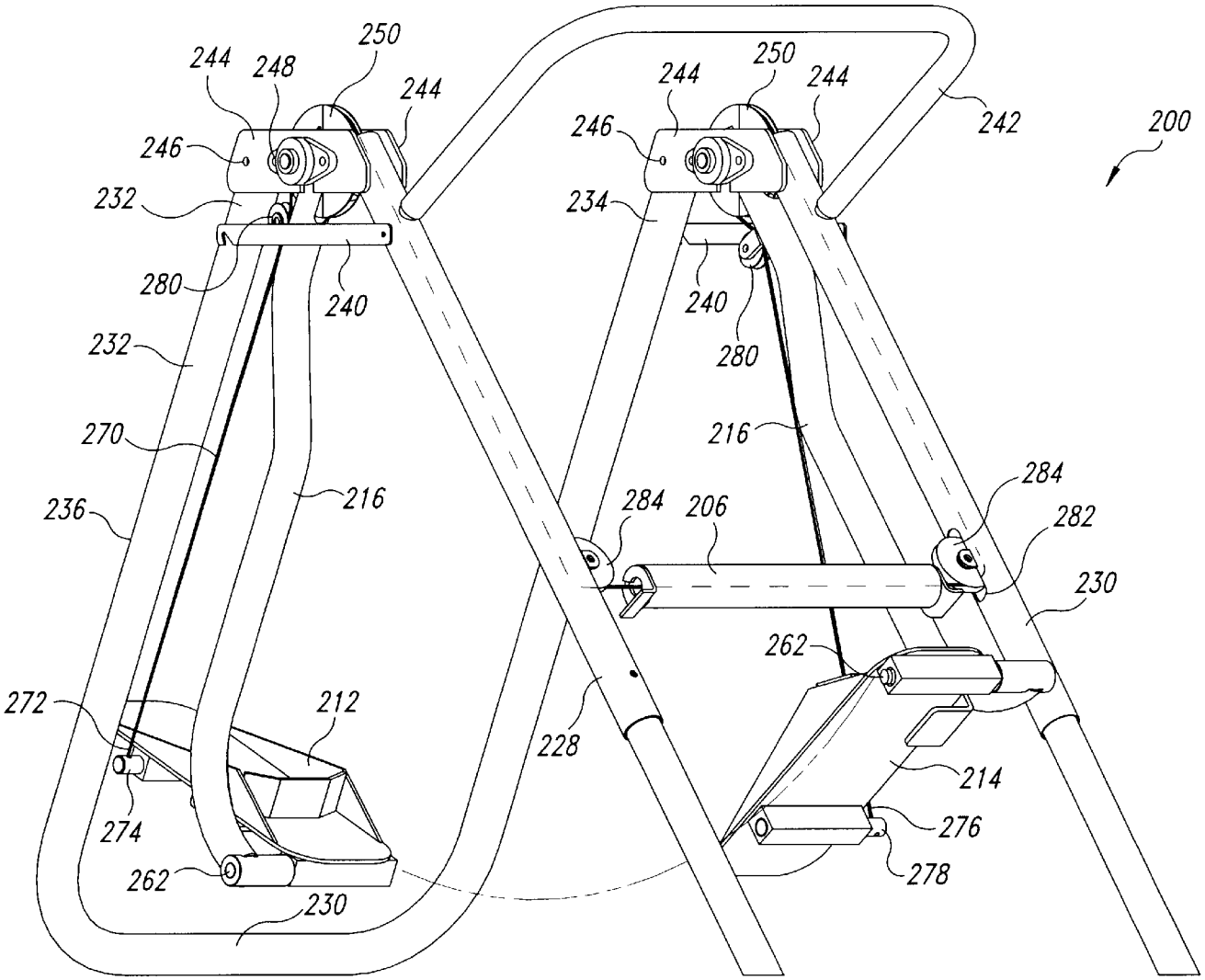
FIG. 22 is a front, right side isometric view of the exercise apparatus of FIG. 20 with the stride length interconnect system components removed and the cover and support frame for the heel lift interconnect system components removed.

As best shown in FIG. 22, the right and left side lift cables 270 pass downward and forward from the pulleys 250 through the right and left support legs 228 and 230, respectively, which are tubular with a hollow center. The lift cables 270 exits each of the right and left support legs 228 and 230 through an inward opening 282 in each leg at which an idler pulley 284 is rotatably mounted to the leg. The lift cables 270 pass over the idler pulleys 284 and terminate with their ends attached to the center portion of a spring assembly 206 having a similar construction and operation as the spring assembly 106 described for apparatus 10. As with the apparatus 10, the right and left pedals 212 and 214 have a dependent heel lift motion, and are cushioned and have their downward travel limited by use of the spring assembly 206. As shown in FIG. 20, the spring assembly is mounted to a support frame 224 having a cover 226.

Figure 21:
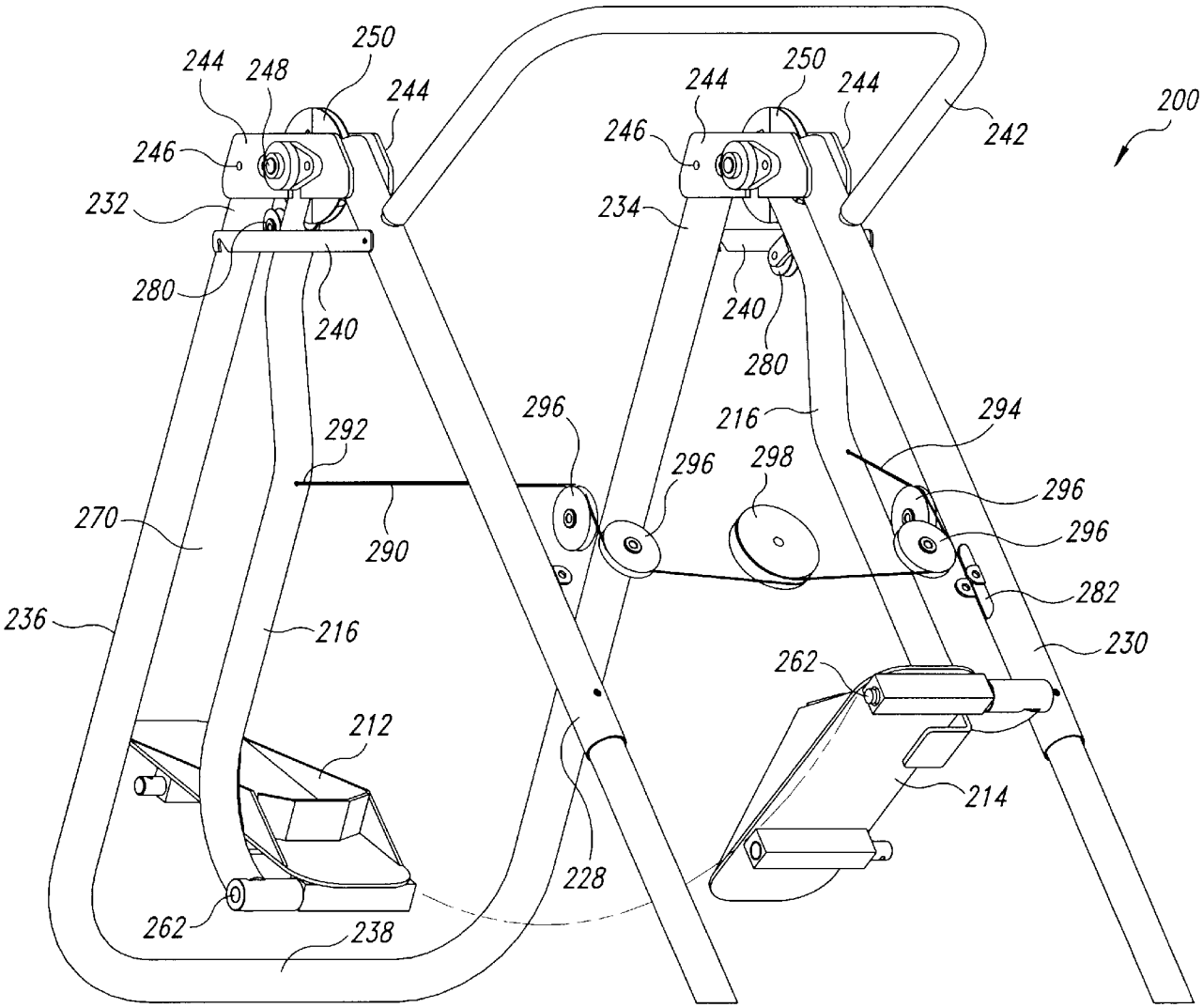
FIG. 21 is a front, right side isometric view of the exercise apparatus of FIG. 20 with the heel lift interconnect system components removed and the cover and support frame for the stride length interconnect system components removed.

As best shown in FIG. 21, the apparatus 200 uses a swing control cable 290 to interconnect the right and left swing arms 216. A right side end 292 of the cable 290 is fixedly attached to the right swing arm 216 and a left side end 294 of the cable is fixedly attached to a left swing arm 216. The swing control cable 290 is entrained on four idler pulleys 296 and wraps around a friction disc brake 298 which applies a friction braking force to the swing control cable 290 as it rotates the friction disc brake in the clockwise and in the counterclockwise directions in response to rearward movement of the right and left swing arms 216. The friction disc brake 298 is of conventional construction. The idler pulleys 296 and the friction disc brake 298 are mounted on the support frame 224 shown in FIG. 20. The swing control cable 290 and the friction disc brake 298 resist rearward movement of the right and left pedals 212 and 214 and the right and left swing arms 216 to which they are attached as the user moves his feet rearward while standing thereon.

As with the apparatus 10, the apparatus 200 has its right and left swing arms 216 and hence the right and left pedals 212 and 214 interconnected to produce a dependent swinging motion, with the rearward movement of one pedal moving the other pedal forward. Also as with the apparatus 10 described above, the apparatus while having right and left stride height dependency and right and left stride length dependency, the amount of stride height used by the user and the amount of stride length used by the user are completely independent of each other.

It will be appreciated that, although specific embodiments of the invention have been described herein for purposes of illustration, various modification may be made without departing from the spirit and scope of the invention. Accordingly, the invention is not limited except as by the appended claims.

We claim:

1. An exercise apparatus for a user to exercise while standing on the user's feet, comprising:

a frame;

right and left foot pedals, said right and left pedals being laterally spaced apart and each having a forward end portion sized to receive a forward end portion of the user's corresponding foot thereon and a rearward end portion sized to receive a rearward end portion of the user's corresponding foot thereon;

an upwardly oriented, right pedal swing arm supporting said right pedal, said right swing arm having an upper end portion pivotally attached to said frame to swing rearward and forward relative thereto and a lower end portion pivotally attached to said forward end portion of said right pedal for rearward and forward reciprocating movement of said right pedal therewith in user variable rearward and forward amounts during the exercise along an arcuate path, said variable rearward amounts of said rearward movement of said right pedal corresponding to the amount of rearward movement of the user's foot on said right pedal applied by the user during the exercise, said lower end portion of said right swing arm supporting said right pedal for downward and upward pivotal movements of said rearward end portion thereof relative to said forward end portion thereof in user variable downward and upward amounts during the exercise, said variable downward amount of said downward movement of said rearward end portion of said right pedal corresponding to the amount of downward movement of the rearward end portion of the user's foot on said rearward end portion of said right pedal applied by the user during the exercise;

an upwardly oriented, left pedal swing arm supporting said left pedal, said left swing arm having an upper end portion pivotally attached to said frame to swing rearward and forward relative thereto and a lower end portion pivotally attached to said forward end portion of said left pedal for rearward and forward reciprocating movement of said left pedal therewith in user variable rearward and forward amounts during the exercise along an arcuate path, said variable rearward amounts of said rearward movement of said left pedal corresponding to the amount of rearward movement of the user's foot on said left pedal applied by the user during the exercise, said lower end portion of said left swing arm supporting said left pedal for downward and upward pivotal movements of said rearward end portion thereof relative to said forward end portion thereof in user variable downward and upward amounts during the exercise, said variable downward amount of said downward movement of said rearward end portion of said left pedal corresponding to the amount of downward movement of the rearward end portion of the user's foot on said rearward end portion of said left pedal applied by the user during the exercise;

a swing control member engaging said frame and said right and left swing arms, in response to said rearward movement of said left swing arm corresponding to the rearward movement of the user's foot on said left pedal applied by the user during the exercise, said swing control member moving said right swing arm forward with said variable forward movement amount thereof corresponding to said variable rearward movement amount of said left swing arm, and in response to said rearward movement of said right swing arm corresponding to the rearward movement of the user's foot on said right pedal applied by the user during the exercise, said swing control member moving said left swing arm forward with said variable forward movement amount thereof corresponding to said variable rearward movement amount of said right swing arm; and upwardly oriented, right and left lift arms, said right lift arm having an upper end portion pivotally attached to said frame and a lower end portion pivotally attached to said rearward end portion of said right pedal, said left lift arm having an upper end portion pivotally attached to said frame and a lower end portion pivotally attached to said rearward end portion of said left pedal, said right and left lift arms being interconnected by an interconnect member such that in response to said downward movement of said rearward end portion of said left pedal corresponding to the downward movement of the rearward end portion of the user's foot on said left pedal applied by the user during the exercise, said interconnect member applies a right side lifting force on said right lift arm to lift said rearward end portion of said right pedal upward with said variable upward movement amount thereof corresponding to said variable downward movement amount of said left pedal, and in response to said downward movement of said rearward end portion of said right pedal corresponding to the downward movement of the rearward end portion of the user's foot on said right pedal applied by the user during the exercise, said interconnect member applies a left side lifting force on said left lift arm to lift said rearward end portion of said left pedal upward with said variable upward movement amount thereof corresponding to said variable downward movement amount of said right pedal, said swing control member and said lift arms being operatively disconnected such that movement of said right and left swing arms by said swing control member and movement of said right and left pedals by said right and left lift arms are independent of each other.

2. The exercise apparatus of claim 1 wherein said interconnect member includes a flexible member.

3. The exercise apparatus of claim 1 wherein said upper end portions of said right and left lift arms are pivotally connected to said frame through right and left links, respectively, a first end portion of said right link being pivotally connected to said upper end portion of said right lift arm and a second end portion of said right link being pivotally connected to said frame, and a first end portion of said left link being pivotally connected to said upper end portion of said left lift arm and a second end portion of said left link being pivotally connected to said frame.

4. The exercise apparatus of claim 3 wherein said second end portions of said right and left links are drivingly connected together by said interconnect member to transmit said right side lifting force resulting from downward movement of the rearward end portion of the user's foot on said left pedal to said rearward end portion of said right pedal, and to transmit said left side lifting force resulting from downward movement of the rearward end portion of the user's foot on said right pedal to said rearward end portion of said left pedal.

5. The exercise apparatus of claim 3 wherein said second end portions of said right and left links are drivingly connected together by said interconnect member which moves in a first direction relative to said frame to transmit said right side lifting force resulting from downward movement of the rearward end portion of the user's foot on said left pedal to said rearward end portion of said right pedal, and which moves in a second direction relative to said frame to transmit said left side lifting force resulting from downward movement of the rearward end portion of the user's foot on said right pedal to said rearward end portion of said left pedal, said interconnect member engaging and compressing a first spring portion against a first stop when moving in said first direction, said first spring portion having a spring constant and length selected to cushion and limit movement of said interconnect member in said first direction and hence downward movement of said rearward end portion of said left pedal, and said interconnect member engaging and compressing a second spring portion against a second stop when moving in said second direction, said second spring portions having a spring constant and length selected to cushion and limit movement of said interconnect member in said second direction and hence downward movement of said rearward end portion of said right pedal.

6. The exercise apparatus of claim 5 wherein said right link is oriented relative to said right lift arm to rotate through successive positions providing decreasing leverage between the right pedal and said interconnect member as said rearward end portion of said right pedal moves downward after said interconnect member has engaged and partially compressed said second spring portion against said second stop, and said left link is oriented relative to said left lift arm to rotate through successive positions providing decreasing leverage between the left pedal and said interconnect member as said rearward end portion of said left pedal moves downward after said interconnect member has engaged and partially compressed said first spring portion against said first stop.

7. The exercise apparatus of claim 5 wherein said first spring portion and said second spring portion are separate first and second springs with inward ends toward each other and outward end away from each other, said outward ends of said first and second springs being positioned to engage said first and second stops, respectively, and said interconnect member extending through said first and second springs and having a spring engagement member fixedly attached thereto at a position between said inward ends of said first and second springs, said spring engagement member engaging said inward end of said first spring when moving in said first direction and engaging said inward end of said second spring when moving in said second direction.

8. The exercise apparatus of claim 6 wherein said first and second springs are positioned in a tubular compartment with said first and second stops being fixedly attached to first and second ends of said compartment, respectively, said interconnect member extending from end to end through said compartment with said spring engagement member positioned therein, said compartment being fixedly attached to said frame.

9. The exercise apparatus of claim 4 wherein said interconnect member includes a flexible drive member extending between said second end portions of said right and left links to transmit said right and left side lifting forces therebetween.

10. The exercise apparatus of claim 9 wherein said right and left links are drivingly attached to right and left drive transmission members mounted for rotation relative to said frame, and said flexible drive member is entrained on said right and left drive transmission members to thereby transmit said right and left side lifting forces between said second end portions of said right and left links.

11. The exercise apparatus of claim 1 wherein said right swing arm and right lift arm together provide swinging support for said right pedal and limit downward travel thereof to provide uninhibited swinging movement of said right pedal out of supporting contact with any structure therebelow, and said left swing arm and left lift arm together provide swinging support for said left pedal and limit downward travel thereof to provide uninhibited swinging movement of said left pedal out of supporting contact with any structure therebelow.

12. The exercise apparatus of claim 1 wherein said swing control member includes a flexible member interconnecting said right and left swing arms.

13. The exercise apparatus of claim 1, further including a resistance device operatively connected to said right and left pedals to resist said rearward movements thereof.

14. The exercise apparatus of claim 13 wherein said resistance device is connected to said right and left swing arms to resist said rearward movements thereof, thereby resisting said rearward movements of said right and left pedals.

15. The exercise apparatus of claim 14 wherein said resistance device is connected to said right and left swing arms through said swing control member.

16. The exercise apparatus of claim 15 wherein said swing control member transmits said rearward movements of said right and left swing arms to said resistance device which resists said rearward movements thereof.

17. The exercise apparatus of claim 16 wherein said resistance device includes a rotatably mounted drive member to which said swing control member transmits said rearward movements of said right and left swing arms, said rearward movements of each of said right and left swing arms being separately applied to said drive member to each rotate said drive member in a single rotational direction and thereby sum said separate rearward movements of said right and left swing arms into a unidirectional rotational output of said drive member, said rotational output of said drive member being transmitted to a brake resisting rotation of said drive member, thereby resisting said rearward movements of said right and left pedals.

18. The exercise apparatus of claim 17 wherein said drive member is a laterally extending drive shaft rotatably supported by said frame, said drive shaft having a right end portion toward a right side of said frame and said right swing arm, and a left end portion toward a left side of said frame and said left swing arm, said rearward movements of said right swing arm being transmitted to said right end portion of said drive shaft and said rearward movements of said left swing arm being transmitted to said left end portion of said drive shaft.

19. The exercise apparatus of claim 1 wherein said swing control member includes a flexible member interconnecting said right and left swing arms to move said right swing arm rearward in response to forward movement of said left swing arm, and to move said left swing arm rearward in response to forward movement of said right swing arm.

20. The exercise apparatus of claim 1, further including right and left handles for grasping by the user during the exercise, said right handle being attached to said right swing arm for travel therewith, and said left handle being attached to said left swing arm for travel therewith.

21. The exercise apparatus of claim 20 wherein said right and left handles include user operable angular adjustments to select an angular position of said right and left handles relative to said right and left swing arms, respectively.

22. The exercise apparatus of claim 1 wherein said frame includes laterally spaced apart right and left side supports frame portions with said upper end portion of said right swing arm and said upper end portion of said right lift arm pivotally attached to said right side support frame portion and said upper end portion of said left swing arm and said upper end portion of said left lift arm pivotally attached to said left side support frame portion.

23. The exercise apparatus of claim 22 wherein said swing control member includes right and left side swing control member portions and said interconnect member includes right and left side interconnect member portions, and wherein said right and left side supports frame portions each includes an enclosure with said enclosure of said right side support frame portion enclosing said right side swing control member portions and said right side interconnect member portions and said enclosure of said left side support frame portion enclosing said left side swing control member portions and said left side interconnect member portions.

24. The exercise apparatus of claim 1 wherein said right and left swing arms are positioned laterally outward of said right and left pedals, respectively, and define a space between said right and left swing arms in which the user stands during the exercise.

25. The exercise apparatus of claim 24 wherein said right and left lift arms are positioned laterally outward of said right and left pedals, respectively.

26. The exercise apparatus of claim 24 wherein said upper end portions of said right and left swing arms are pivotally attached to said frame at a height above said right and left pedals when in a resting position of between 30 to 50 inches.

27. The exercise apparatus of claim 24 wherein said upper end portions of said right and left swing arms are pivotally attached to said frame at a height above said right and left pedals, respectively, to position a right hip joint and a left hip joint of the user with an average adult height standing on said right and left pedals during the exercise at about said height of said pivotal attachments above of said right and left swing arms.

28. The exercise apparatus of claim 1 wherein said lower end portions of said right and left swing arms are pivotally attached to said forward ends portions of said right and left pedals at right and left pivot locations, respectively, and further including right and left foot stop members attached to said right and left pedals, respectively, said right and left foot stop members being positioned on said right and left pedals to engage and limit forward positioning of the forward portions of the user's right and left feet on said right and left pedals at positions rearward of said right and left pivot locations.

29. The exercise apparatus of claim 28 wherein said right and left foot stop members are toe clips.

30. An exercise apparatus for a user to exercise while standing on the user's feet, comprising:

a frame;

right and left foot pedals, said right and left pedals being laterally spaced apart and each having a forward end portion sized to receive a forward end portion of the user's corresponding foot thereon and a rearward end portion sized to receive a rearward end portion of the user's corresponding foot thereon;

an upwardly oriented, right pedal swing arm supporting said right pedal, said right swing arm having an upper end portion pivotally attached to said frame to swing rearward and forward relative thereto and a lower end portion pivotally attached to said right pedal for rearward and forward reciprocating movement of said right pedal therewith in user variable rearward and forward amounts during the exercise along an arcuate path, said variable rearward amounts of said rearward movement of said right pedal corresponding to the amount of rearward movement of the user's foot on said right pedal applied by the user during the exercise, said lower end portion of said right swing arm supporting said right pedal for downward and upward movements of said rearward end portion thereof relative to said forward end portion thereof in user variable downward and upward amounts during the exercise, said variable downward amount of said downward movement of said rearward end portion of said right pedal corresponding to the amount of downward movement of the rearward end portion of the user's foot on said rearward end portion of said right pedal applied by the user during the exercise;

an upwardly oriented, left pedal swing arm supporting said left pedal, said left swing arm having an upper end portion pivotally attached to said frame to swing rearward and forward relative thereto and a lower end portion pivotally attached to said left pedal for rearward and forward reciprocating movement of said left pedal therewith in user variable rearward and forward amounts during the exercise along an arcuate path, said variable rearward amounts of said rearward movement of said left pedal corresponding to the amount of rearward movement of the user's foot on said left pedal applied by the user during the exercise, said lower end portion of said left swing arm supporting said left pedal for downward and upward movements of said rearward end portion thereof relative to said forward end portion thereof in user variable downward and upward amounts during the exercise, said variable downward amount of said downward movement of said rearward end portion of said left pedal corresponding to the amount of downward movement of the rearward end portion of the user's foot on said rearward end portion of said left pedal applied by the user during the exercise;

a swing control member engaging said frame and said right and left swing arms, in response to said rearward movement of said left swing arm corresponding to the rearward movement of the user's foot on said left pedal applied by the user during the exercise, said swing control member moving said right swing arm forward with said variable forward movement amount thereof corresponding to said variable rearward movement amount of said left swing arm, and in response to said rearward movement of said right swing arm corresponding to the rearward movement of the user's foot on said right pedal applied by the user during the exercise, said swing control member moving said left swing arm forward with said variable forward movement amount thereof corresponding to said variable rearward movement amount of said right swing arm; and upwardly oriented, right and left lift arms, said right lift arm having an upper end portion pivotally attached to said frame and a lower end portion pivotally attached to said right pedal, said left lift arm having an upper end portion pivotally attached to said frame and a lower end portion pivotally attached to said left pedal, in response to said downward movement of said rearward end portion of said left pedal corresponding to the downward movement of the rearward end portion of the user's foot on said left pedal applied by the user during the exercise, said right lift arm moving said rearward end portion of said right pedal upward with said variable upward movement amount thereof corresponding to said variable downward movement amount of said left pedal, and in response to said downward movement of said rearward end portion of said right pedal corresponding to the downward movement of the rearward end portion of the user's foot on said right pedal applied by the user during the exercise, said left lift arm moving said rearward end portion of said left pedal upward with said variable upward movement amount thereof corresponding to said variable downward movement amount of said right pedal, said swing control member and said lift arms being operatively disconnected such that movement of said right and left swing arms by said swing control member and movement of said right and left pedals by said right and left lift arms are independent of each other.

31. The exercise apparatus of claim 30 wherein said swing control member includes a flexible member interconnecting said right and left swing arms.

32. The exercise apparatus of claim 30 wherein said right and left lift arms are interconnected by an interconnect member, such that in response to said downward movement of said rearward end portion of said left pedal corresponding to the downward movement of the rearward end portion of the user's foot on said left pedal applied by the user during the exercise, said interconnect member applies a right side lifting force on said right lift arm to lift said rearward end portion of said right pedal upward with said variable upward movement amount thereof corresponding to said variable downward movement amount of said left pedal, and in response to said downward movement of said rearward end portion of said right pedal corresponding to the downward movement of the rearward end portion of the user's foot on said right pedal applied by the user during the exercise, said interconnect member applies a left side lifting force on said left lift arm to lift said rearward end portion of said left pedal upward with said variable upward movement amount thereof corresponding to said variable downward movement amount of said right pedal.

33. The exercise apparatus of claim 32 wherein said interconnect member includes a flexible member.

34. The exercise apparatus of claim 30 wherein said right swing arm and right lift arm together provide swinging support for said right pedal and limit downward travel thereof to provide uninhibited swinging movement of said right pedal out of supporting contact with any structure therebelow, and said left swing arm and left lift arm together provide swinging support for said left pedal and limit downward travel thereof to provide uninhibited swinging movement of said left pedal out of supporting contact with any structure therebelow.

35. An exercise apparatus for a user to exercise while standing on the user's feet, comprising:

a frame;

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing arm supporting said right pedal, said right swing arm having an upper end portion pivotally attached to said frame to swing rearward and forward relative thereto and a lower end portion attached to said right pedal for rearward and forward reciprocating movement of said right pedal therewith in user variable rearward and forward amounts during the exercise along an arcuate path, said variable rearward amounts of said rearward movement of said right pedal corresponding to the amount of rearward movement of the user's foot on said right pedal applied by the user during the exercise, said lower end portion of said right swing arm supporting said right pedal for downward and upward movements of said rearward end portion thereof relative to said forward end portion thereof in user variable downward and upward amounts during the exercise, said variable downward amount of said downward movement of said rearward end portion of said right pedal corresponding to the amount of downward movement of the rearward end portion of the user's foot on said rearward end portion of said right pedal applied by the user during the exercise;

a left pedal swing arm supporting said left pedal, said left swing arm having an upper end portion pivotally attached to said frame to swing rearward and forward relative thereto and a lower end portion attached to said left pedal for rearward and forward reciprocating movement of said left pedal therewith in user variable rearward and forward amounts during the exercise along an arcuate path, said variable rearward amounts of said rearward movement of said left pedal corresponding to the amount of rearward movement of the user's foot on said left pedal applied by the user during the exercise, said lower end portion of said left swing arm supporting said left pedal for downward and upward movements of said rearward end portion thereof relative to said forward end portion thereof in user variable downward and upward amounts during the exercise, said variable downward amount of said downward movement of said rearward end portion of said left pedal corresponding to the amount of downward movement of the rearward end portion of the user's foot on said rearward end portion of said left pedal applied by the user during the exercise;

a swing control member engaging said frame and said right and left swing arms, in response to said rearward movement of said left swing arm corresponding to the rearward movement of the user's foot on said left pedal applied by the user during the exercise, said swing control member moving said right swing arm forward with said variable forward movement amount thereof corresponding to said variable rearward movement amount of said left swing arm, and in response to said rearward movement of said right swing arm corresponding to the rearward movement of the user's foot on said right pedal applied by the user during the exercise, said swing control member moving said left swing arm forward with said variable forward movement amount thereof corresponding to said variable rearward movement amount of said right swing arm; and a lift control member engaging said frame and said right and left pedals, in response to said downward movement of said rearward end portion of said left pedal corresponding to the downward movement of the rearward end portion of the user's foot on said left pedal applied by the user during the exercise, said lift member moving said rearward end portion of said right pedal upward with said variable upward movement amount thereof corresponding to said variable downward movement amount of said left pedal, and in response to said downward movement of said rearward end portion of said right pedal corresponding to the downward movement of the rearward end portion of the user's foot on said right pedal applied by the user during the exercise, said lift member moving said rearward end portion of said left pedal upward with said variable upward movement amount thereof corresponding to said variable downward movement amount of said right pedal, said swing control member and said lift member being operatively disconnected such that movement of said right and left swing arms by said swing control member and movement of said right and left pedals by said lift member are independent of each other.

36. The exercise apparatus of claim 35 wherein said swing control member includes a flexible member interconnecting said right and left swing arms.

37. The exercise apparatus of claim 35 wherein said lift control member includes a flexible member interconnecting said right and left pedals.

38. The exercise apparatus of claim 35 wherein said right and left swing arms and said lift control member together provides swinging support for said right and left pedals and limit downward travel thereof to provide uninhibited swinging movement of said right and left pedals out of supporting contact with any structure therebelow.

39. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing arm supporting said right pedal for rearward and forward swinging motion and having a lower end portion attached to said right pedal for rearward and forward reciprocating movement of said right pedal therewith in user variable rearward and forward amounts during the exercise along a right path, said variable rearward amounts of said rearward movement of said right pedal corresponding to the amount of rearward movement of the user's foot on said right pedal applied by the user during the exercise, said lower end portion of said right swing arm supporting said right pedal for downward and upward movements of said rearward end portion thereof relative to said forward end portion thereof in user variable downward and upward amounts during the exercise, said variable downward amount of said downward movement of said rearward end portion of said right pedal corresponding to the amount of downward movement of the rearward end portion of the user's foot on said rearward end portion of said right pedal applied by the user during the exercise;

a left pedal swing arm supporting said left pedal for rearward and forward swinging motion and having a lower end portion attached to said left pedal for rearward and forward reciprocating movement of said left pedal therewith in user variable rearward and forward amounts during the exercise along an a left path, said variable rearward amounts of said rearward movement of said left pedal corresponding to the amount of rearward movement of the user's foot on said left pedal applied by the user during the exercise, said lower end portion of said left swing arm supporting said left pedal for downward and upward movements of said rearward end portion thereof relative to said forward end portion thereof in user variable downward and upward amounts during the exercise, said variable downward amount of said downward movement of said rearward end portion of said left pedal corresponding to the amount of downward movement of the rearward end portion of the user's foot on said rearward end portion of said left pedal applied by the user during the exercise;

a swing control member engaging said right and left swing arms, in response to said rearward movement of said left swing arm corresponding to the rearward movement of the user's foot on said left pedal applied by the user during the exercise, said swing control member moving said right swing arm forward with said variable forward movement amount thereof corresponding to said variable rearward movement amount of said left swing arm, and in response to said rearward movement of said right swing arm corresponding to the rearward movement of the user's foot on said right pedal applied by the user during the exercise, said swing control member moving said left swing arm forward with said variable forward movement amount thereof corresponding to said variable rearward movement amount of said right swing arm; and a lift control member engaging said right and left pedals, in response to said downward movement of said rearward end portion of said left pedal corresponding to the downward movement of the rearward end portion of the user's foot on said left pedal applied by the user during the exercise, said lift control member moving said rearward end portion of said right pedal upward with said variable upward movement amount thereof corresponding to said variable downward movement amount of said left pedal, and in response to said downward movement of said rearward end portion of said right pedal corresponding to the downward movement of the rearward end portion of the user's foot on said right pedal applied by the user during the exercise, said lift control member moving said rearward end portion of said left pedal upward with said variable upward movement amount thereof corresponding to said variable downward movement amount of said right pedal.

40. The exercise apparatus of claim 39 wherein said swing control member and said lift control member are operatively disconnected such that movement of said right and left swing arms by said swing control member and movement of said right and left pedals by said lift control member are independent of each other.

41. The exercise apparatus of claim 39 wherein said swing control member includes a flexible member interconnecting said right and left swing arms.

42. The exercise apparatus of claim 39 wherein said lift control member includes a flexible member interconnecting said right and left pedals.

43. The exercise apparatus of claim 39 wherein said right and left swing arms and said lift control member together provides swinging support for said right and left pedals and limit downward travel thereof to provide uninhibited swinging movement of said right and left pedals out of supporting contact with any structure therebelow.

44. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith in user variable rearward and forward amounts during the exercise along a right path, said variable rearward amount of said rearward movement of said right pedal corresponding to the amount of rearward movement of the user's foot on said right pedal applied by the user during the exercise, said lower end portion of said right swing member supporting said right pedal for downward and upward movements of said rearward end portion thereof relative to said forward end portion thereof in user variable downward and upward amounts during the exercise, said variable downward amount of said downward movement of said rearward end portion of said right pedal corresponding to the amount of downward movement of the rearward end portion of the user's foot on said rearward end portion of said right pedal applied by the user during the exercise;

a left pedal swing member supporting said left pedal for rearward and forward swinging motion and having a lower end portion attached to said left pedal for rearward and forward reciprocating movement of said left pedal therewith in user variable rearward and forward amounts during the exercise along a left path, said variable rearward amount of said rearward movement of said left pedal corresponding to the amount of rearward movement of the user's foot on said left pedal applied by the user during the exercise, said lower end portion of said left swing member supporting said left pedal for downward and upward movements of said rearward end portion thereof relative to said forward end portion thereof in user variable downward and upward amounts during the exercise, said variable downward amount of said downward movement of said rearward end portion of said left pedal corresponding to the amount of downward movement of the rearward end portion of the user's foot on said rearward end portion of said left pedal applied by the user during the exercise;

a swing control member engaging said right and left swing members, in response to said rearward movement of said left swing member corresponding to the rearward movement of the user's foot on said left pedal applied by the user during the exercise, said swing control member moving said right swing member forward with said variable forward movement amount thereof corresponding to said variable rearward movement amount of said left swing member, and in response to said rearward movement of said right swing member corresponding to the rearward movement of the user's foot on said right pedal applied by the user during the exercise, said swing control member moving said left swing member forward with said variable forward movement amount thereof corresponding to said variable rearward movement amount of said right swing member; and a lift control member engaging said right and left pedals, in response to said downward movement of said rearward end portion of said left pedal corresponding to the downward movement of the rearward end portion of the user's foot on said left pedal applied by the user during the exercise, said lift control member moving said rearward end portion of said right pedal upward with said variable upward movement amount thereof corresponding to said variable downward movement amount of said left pedal, and in response to said downward movement of said rearward end portion of said right pedal corresponding to the downward movement of the rearward end portion of the user's foot on said right pedal applied by the user during the exercise, said lift control member moving said rearward end portion of said left pedal upward with said variable upward movement amount thereof corresponding to said variable downward movement amount of said right pedal.

45. The exercise apparatus of claim 44 wherein said swing control member and said lift control member being operatively disconnected such that movement of said right and left swing members by said swing control member and movement of said right and left pedals by said lift control member are independent of each other.

46. The exercise apparatus of claim 44 wherein said swing control member includes a flexible member interconnecting said right and left swing members.

47. The exercise apparatus of claim 44 wherein said lift control member includes a flexible member interconnecting said right and left pedals.

48. The exercise apparatus of claim 44 wherein said right and left swing members and said lift control member together provides swinging support for said right and left pedals and limit downward travel thereof to provide uninhibited swinging movement of said right and left pedals out of supporting contact with any structure therebelow.

49. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith along a right path, said lower end portion of said right swing member supporting said right pedal for downward and upward rotational movements of said rearward end portion thereof relative to said forward end portion thereof in user variable amounts during the exercise;

a left pedal swing member supporting said left pedal for rearward and forward swinging motion and having a lower end portion attached to said left pedal for rearward and forward reciprocating movement of said left pedal therewith along a left path, said lower end portion of said left swing member supporting said left pedal for downward and upward rotational movements of said rearward end portion thereof relative to said forward end portion thereof in user variable amounts during the exercise; and a lift control member engaging said right and left pedals, in response to said downward movement of said rearward end portion of said left pedal, said lift control member moving said rearward end portion of said right pedal upward, and in response to said downward movement of said rearward end portion of said right pedal, said lift control member moving said rearward end portion of said left pedal upward.

50. The exercise apparatus of claim 49 wherein said lift control member includes a flexible member interconnecting said right and left pedals.

51. The exercise apparatus of claim 49 wherein said lift control member includes right and left lift arms and an interconnect member, said right lift arm having a pivotally supported upper end portion and a lower end portion pivotally attached to said right pedal, said left lift arm having a pivotally supported upper end portion and a lower end portion pivotally attached to said left pedal, said right and left lift arms being interconnected by said interconnect member such that in response to said downward movement of said rearward end portion of said left pedal, said interconnect member applies a right side lifting force on said right lift arm to lift said rearward end portion of said right pedal upward, and in response to said downward movement of said rearward end portion of said right pedal, said interconnect member applies a left side lifting force on said left lift arm to lift said rearward end portion of said left pedal upward.

52. The exercise apparatus of claim 49 wherein said right and left swing members and said lift control member together provides swinging support for said right and left pedals and limit downward travel thereof to provide uninhibited swinging movement of said right and left pedals out of supporting contact with any structure therebelow.

53. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith, said lower end portion of said right swing member supporting said right pedal for downward and upward movements of said rearward end portion thereof relative to said forward end portion thereof;

a left pedal swing member supporting said left pedal for rearward and forward swinging motion and having a lower end portion attached to said left pedal for rearward and forward reciprocating movement of said left pedal therewith, said lower end portion of said left swing member supporting said left pedal for downward and upward movements of said rearward end portion thereof relative to said forward end portion thereof;

a swing control member engaging said right and left swing members, in response to said rearward movement of said left swing member, said swing control member moving said right swing member forward, and in response to said rearward movement of said right swing member, said swing control member moving said left swing member forward; and a lift control member engaging said right and left pedals, in response to said downward movement of said rearward end portion of said left pedal, said lift control member moving said rearward end portion of said right pedal upward, and in response to said downward movement of said rearward end portion of said right pedal, said lift control member moving said rearward end portion of said left pedal upward, said swing control member and said lift control member being operatively disconnected such that movement of said right and left swing members by said swing control member and movement of said right and left pedals by said lift control member are independent of each other.

54. The exercise apparatus of claim 53 wherein said swing control member moves said right swing member forward in a forward amount corresponding to a rearward amount of said rearward movement of said left swing member, and moves said left swing member forward in a forward amount corresponding to a rearward amount of said rearward movement of said right swing member.

55. The exercise apparatus of claim 53 wherein said lift control member moves said rearward end portion of said right pedal upward in an upward amount corresponding to a downward amount of said downward movement of said left pedal, and moves said rearward end portion of said left pedal upward in an upward amount corresponding to a downward amount of said downward movement of said right pedal.

56. The exercise apparatus of claim 53 wherein said swing control member moves said right swing member forward in a forward amount corresponding to a rearward amount of said rearward movement of said left swing member, and moves said left swing member forward in a forward amount corresponding to a rearward amount of said rearward movement of said right swing member, and said lift control member moves said rearward end portion of said right pedal upward in an upward amount corresponding to a downward amount of said downward movement of said left pedal, and moves said rearward end portion of said left pedal upward in an upward amount corresponding to a downward amount of said downward movement of said right pedal.

57. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith, said lower end portion of said right swing member supporting said right pedal for downward and upward movements of said rearward end portion thereof relative to said forward end portion thereof;

a left pedal swing member supporting said left pedal for rearward and forward swinging motion and having a lower end portion attached to said left pedal for rearward and forward reciprocating movement of said left pedal therewith, said lower end portion of said left swing member supporting said left pedal for downward and upward movements of said rearward end portion thereof relative to said forward end portion thereof; and a lift control member engaging said right and left pedals, in response to said downward movement of said rearward end portion of said left pedal, said lift control member moving said rearward end portion of said right pedal upward, and in response to said downward movement of said rearward end portion of said right pedal, said lift control member moving said rearward end portion of said left pedal upward, said lift control member being operatively disconnected from said right and left swing members such that upward and downward movements of said right and left pedals by said lift control member are independent of said rearward and forward reciprocating movements of said right and left swing members.

58. The exercise apparatus of claim 57 wherein said lift control member moves said rearward end portion of said right pedal upward in an upward amount corresponding to a downward amount of said downward movement of said left pedal, and moves said rearward end portion of said left pedal upward in an upward amount corresponding to a downward amount of said downward movement of said right pedal.

59. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith, said lower end portion of said right swing member supporting said right pedal for downward and upward movements of said rearward end portion thereof relative to said forward end portion thereof;

a left pedal swing member supporting said left pedal for rearward and forward swinging motion and having a lower end portion attached to said left pedal for rearward and forward reciprocating movement of said left pedal therewith, said lower end portion of said left swing member supporting said left pedal for downward and upward movements of said rearward end portion thereof relative to said forward end portion thereof; and a swing control member engaging said right and left swing members, in response to said rearward movement of said left swing member, said swing control member moving said right swing member forward, and in response to said rearward movement of said right swing member, said swing control member moving said left swing member forward, said swing control member being operatively disconnected from said right and left pedals such that rearward and forward reciprocating movements of said right and left swing members by said swing control member are independent of said upward and downward movements of said right and left pedals.

60. The exercise apparatus of claim 59 wherein said swing control member moves said right swing member forward in a forward amount corresponding to a rearward amount of said rearward movement of said left swing member, and moves said left swing member forward in a forward amount corresponding to a rearward amount of said rearward movement of said right swing member.

61. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith in rearward and forward amounts variable by user applied rearward and forward foot movements while on said right and left pedals during the exercise, said lower end portion of said right swing member supporting said right pedal for downward and upward movements of said rearward end portion thereof relative to said forward end portion thereof in downward and upward amounts variable by user applied downward and upward foot movements while on said right and left pedals during the exercise;

a left pedal swing member supporting said left pedal for rearward and forward swinging motion and having a lower end portion attached to said left pedal for rearward and forward reciprocating movement of said left pedal therewith in rearward and forward amounts variable by user applied rearward and forward foot movements while on said right and left pedals during the exercise, said lower end portion of said left swing member supporting said left pedal for downward and upward movements of said rearward end portion thereof relative to said forward end portion thereof in downward and upward amounts variable by user applied downward and upward foot movements while on said right and left pedals during the exercise;

a swing control member engaging said right and left swing members, in response to said rearward movement of said left swing member corresponding to the rearward movement of the user's foot on said left pedal applied by the user during the exercise, said swing control member moving said right swing member forward with said variable forward movement amount thereof corresponding to said variable rearward movement amount of said left swing member, and in response to said rearward movement of said right swing member corresponding to the rearward movement of the user's foot on said right pedal applied by the user during the exercise, said swing control member moving said left swing member forward with said variable forward movement amount thereof corresponding to said variable rearward movement amount of said right swing member; and a lift control member engaging said right and left pedals, in response to said downward movement of said rearward end portion of said left pedal corresponding to the downward movement of the rearward end portion of the user's foot on said left pedal applied by the user during the exercise, said lift control member moving said rearward end portion of said right pedal upward with said variable upward movement amount thereof corresponding to said variable downward movement amount of said left pedal, and in response to said downward movement of said rearward end portion of said right pedal corresponding to the downward movement of the rearward end portion of the user's foot on said right pedal applied by the user during the exercise, said lift control member moving said rearward end portion of said left pedal upward with said variable upward movement amount thereof corresponding to said variable downward movement amount of said right pedal.

62. The exercise apparatus of claim 61 wherein said swing control member and said lift control member being operatively disconnected such that movement of said right and left swing members by said swing control member and movement of said right and left pedals by said lift control member are independent of each other.

63. The exercise apparatus of claim 61 wherein said swing control member includes a flexible member interconnecting said right and left swing members.

64. The exercise apparatus of claim 61 wherein said lift control member includes a flexible member interconnecting said right and left pedals.

65. The exercise apparatus of claim 61 wherein said lift control member includes right and left lift arms and an interconnect member, said right lift arm having a pivotally supported upper end portion and a lower end portion pivotally attached to said right pedal, said left lift arm having a pivotally supported upper end portion and a lower end portion pivotally attached to said left pedal, said right and left lift arms being interconnected by said interconnect member such that in response to said downward movement of said rearward end portion of said left pedal corresponding to the downward movement of the rearward end portion of the user's foot while on said left pedal applied by the user during the exercise, said interconnect member applies a right side lifting force on said right lift arm to lift said rearward end portion of said right pedal upward in an upward movement amount corresponding to a downward movement amount of said left pedal, and in response to said downward movement of said rearward end portion of said right pedal corresponding to the downward movement of the rearward end portion of the user's foot while on said right pedal applied by the user during the exercise, said interconnect member applies a left side lifting force on said left lift arm to lift said rearward end portion of said left pedal upward in an upward movement amount corresponding to a downward movement amount of said right pedal.

66. The exercise apparatus of claim 65 wherein said interconnect member includes a flexible member interconnecting said right and left lift arms.

67. The exercise apparatus of claim 61 wherein said right and left swing members and said lift control member together provides swinging support for said right and left pedals and limit downward travel thereof to provide uninhibited swinging movement of said right and left pedals out of supporting contact with any structure therebelow.

68. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith in rearward and forward amounts variable by user applied rearward and forward foot movements while on said right and left pedals during the exercise, said lower end portion of said right swing member supporting said right pedal for downward and upward movements of said rearward end portion thereof relative to said forward end portion thereof in downward and upward amounts variable by user applied downward and upward foot movements while on said right and left pedals during the exercise;

a left pedal swing member supporting said left pedal for rearward and forward swinging motion and having a lower end portion attached to said left pedal for rearward and forward reciprocating movement of said left pedal therewith in rearward and forward amounts variable by user applied rearward and forward foot movements while on said right and left pedals during the exercise, said lower end portion of said left swing member supporting said left pedal for downward and upward movements of said rearward end portion thereof relative to said forward end portion thereof in downward and upward amounts variable by user applied downward and upward foot movements while on said right and left pedals during the exercise;

a right lift member supporting said right pedal and applying a right side lifting force on said right pedal to lift said rearward end portion of said right pedal upward in a user variable upward movement amount corresponding to user applied foot movements while on said right and left pedals during the exercise; and a left lift member supporting said left pedal and applying a left side lifting force on said left pedal to lift said rearward end portion of said left pedal upward in a user variable upward movement amount corresponding to user applied foot movements while on said right and left pedals during the exercise, said right and left swing members and said right and left lift members together providing swinging support for said right and left pedals and limiting downward travel thereof to provide uninhibited swinging movement of said right and left pedals out of supporting contact with any structure therebelow.

69. An exercise apparatus for a user to exercise while standing on the user's feet, comprising:

right and left foot pedals, said right and left pedals being laterally spaced apart and each having a forward end portion to receive a forward end portion of the user's corresponding foot thereon and a rearward end portion to receive a rearward end portion of the user's corresponding foot thereon;

a right pedal swing member supporting said right pedal for rearward and forward swinging motion and having a lower end portion attached to said right pedal for rearward and forward reciprocating movement of said right pedal therewith, said lower end portion of said right swing member supporting said right pedal for downward and upward movements of said rearward end portion thereof relative to said forward end portion thereof;

a left pedal swing member supporting said left pedal for rearward and forward swinging motion and having a lower end portion attached to said left pedal for rearward and forward reciprocating movement of said left pedal therewith, said lower end portion of said left swing member supporting said left pedal for downward and upward movements of said rearward end portion thereof relative to said forward end portion thereof;

a right lift member supporting said right pedal and applying a right side lifting force on said right pedal to lift said rearward end portion of said right pedal upward during the exercise; and a left lift member supporting said left pedal and applying a left side lifting force on said left pedal to lift said rearward end portion of said left pedal upward during the exercise, said right and left swing members and said right and left lift members together providing swinging support for said right and left pedals and limiting downward travel thereof to provide uninhibited swinging movement of said right and left pedals out of supporting contact with any structure therebelow, said right and left swing members and said right and left lift members being operatively disconnected such that rearward and forward movements of said right and left pedals by said right and left swing members and downward and upward movements of said rearward end portions of said right and left pedals by said right and left lift members are independent of each other, whereby swinging movements of said right and left pedals and lifting movements thereof may be independently performed by the user.

70. The exercise apparatus of 69 wherein said right lift member is a right side suspension member supporting said right pedal from above and said left lift member is a left side suspension member supporting said left pedal from above.

71. The exercise apparatus of 69 wherein said right side suspension member has a lower end portion attached to said rearward end portion of said right pedal and said left side suspension member has a lower end portion attached to said rearward end portion of said left pedal.

72. The exercise apparatus of 71 wherein said right swing member has a lower end portion attached to said forward end portion of said right pedal and said left swing member has a lower end portion attached to said forward end portion of said left pedal.

73. An exercise apparatus for a user to exercise while standing on the user's feet, comprising:

right and left foot pedals, each having a forward end portion to receive a forward end portion of the user's corresponding foot thereon and a rearward end portion to receive a rearward end portion of the user's corresponding foot thereon, said right pedal being supported for rearward and forward reciprocating movement thereof while permitting said rearward end portion of said right pedal to move downward and upward relative to said forward end portion thereof, and said left pedal being supported for rearward and forward reciprocating movement thereof while permitting said rearward end portion of said left pedal to move downward and upward relative to said forward end portion thereof;

a first pedal interconnect member engaging said right and left pedals, in response to said rearward movement of said left pedal, said first pedal interconnect member moving said right pedal forward, and in response to said rearward movement of said right pedal, said first pedal interconnect member moving said left pedal forward; and a second pedal interconnect member engaging said right and left pedals, in response to said downward movement of said rearward end portion of said left pedal, said second pedal interconnect member moving said rearward end portion of said right pedal upward, and in response to said downward movement of said rearward end portion of said right pedal, said second pedal interconnect member moving said rearward end portion of said left pedal upward, said first and second pedal interconnect members being operatively disconnected such that said rearward and forward reciprocating movements of said right and left pedals are independent of said upward and downward movements of said rearward end portions of said right and left pedals.

74. The exercise apparatus of claim 73 wherein said first pedal interconnect member moves said right pedal forward in a forward amount corresponding to a rearward amount of said rearward movement of said left pedal, and moves said left pedal forward in a forward amount corresponding to a rearward amount of said rearward movement of said right pedal.

75. The exercise apparatus of claim 73 wherein said second pedal interconnect member moves said rearward end portion of said right pedal upward in an upward amount corresponding to a downward amount of said downward movement of said rearward end portion of said left pedal, and moves said rearward end portion of said left pedal upward in an upward amount corresponding to a downward amount of said downward movement of said rearward end portion of said right pedal.

76. The exercise apparatus of claim 73 wherein said first pedal interconnect member moves said right pedal forward in a forward amount corresponding to a rearward amount of said rearward movement of said left pedal, and moves said left pedal forward in a forward amount corresponding to a rearward amount of said rearward movement of said right pedal, and said second pedal interconnect member moves said rearward end portion of said right pedal upward in an upward amount corresponding to a downward amount of said downward movement of said rearward end portion of said left pedal, and moves said rearward end portion of said left pedal upward in an upward amount corresponding to a downward amount of said downward movement of said rearward end portion of said right pedal.

77. The exercise apparatus of claim 73 wherein said first pedal interconnect member drivingly engages a brake resisting said rearward movement of said right and left pedals.

78. The exercise apparatus of claim 73 wherein each of said right and left pedals is operatively connected to a resistance member which provides increasing resistance to said downward movement of said rearward end portion thereof when moving downward under the weight of the user.

79. The exercise apparatus of claim 78 wherein said resistance member further limits the extent of said downward movement of said rearward end portions of said right and left pedals.

80. The exercise apparatus of claim 78 wherein said resistance member further provides an upward pedal return force to said rearward end portions of said right and left pedals during at least a portion of said upward movement thereof when the weight of the user is at least partially removed therefrom.

81. An exercise apparatus for a user to exercise while standing on the user's feet, comprising:

right and left foot pedals, each having a forward end portion to receive a forward end portion of the user's corresponding foot thereon and a rearward end portion to receive a rearward end portion of the user's corresponding foot thereon, said right pedal being supported for rearward and forward reciprocating movement thereof while permitting said rearward end portion of said right pedal to move downward and upward relative to said forward end portion thereof, and said left pedal being supported for rearward and forward reciprocating movement thereof while permitting said rearward end portion of said left pedal to move downward and upward relative to said forward end portion thereof;

a pedal interconnect member engaging said right and left pedals, in response to said rearward movement of said left pedal, said pedal interconnect member moving said right pedal forward, and in response to said rearward movement of said right pedal, said pedal interconnect member moving said left pedal forward;

said rearward end portion of said right pedal being downwardly movable relative to said forward end portion thereof in user variable downward amounts within a range of maximum downward movement during the exercise corresponding to the amount of downward movement of the rearward end portion of the user's foot on said rearward end portion of said right pedal applied by the user during the exercise, said rearward end portion of said right pedal being independently downwardly movable with respect to said rearward and forward reciprocating movements of said right and left pedals; and said rearward end portion of said left pedal being downwardly movable relative to said forward end portion thereof in user variable downward amounts within a range of maximum downward movement during the exercise corresponding to the amount of downward movement of the rearward end portion of the user's foot on said rearward end portion of said left pedal applied by the user during the exercise, said rearward end portion of said left pedal being independently downwardly movable with respect to said rearward and forward reciprocating movements of said right and left pedals.

82. The exercise apparatus of claim 81 wherein said pedal interconnect member moves said right pedal forward in a forward amount corresponding to a rearward amount of said rearward movement of said left pedal, and moves said left pedal forward in a forward amount corresponding to a rearward amount of said rearward movement of said right pedal.

83. An exercise apparatus for a user to exercise while standing on the user's feet, comprising:

right and left foot pedals, each having a forward end portion to receive a forward end portion of the user's corresponding foot thereon and a rearward end portion to receive a rearward end portion of the user's corresponding foot thereon, said right pedal being supported for rearward and forward reciprocating movement thereof while permitting said rearward end portion of said left pedal to move downward and upward relative to said forward end portion thereof, and said left pedal being supported for rearward and forward reciprocating movement thereof while permitting said rearward end portion of said left pedal to move downward and upward relative to said forward end portion thereof;

a pedal interconnect member engaging said right and left pedals, in response to said rearward movement of said left pedal, said pedal interconnect member moving said right pedal forward, and in response to said rearward movement of said right pedal, said pedal interconnect member moving said left pedal forward;

said rearward end portion of said right pedal being downwardly movable relative to said forward end portion thereof in user variable downward amounts within a range of maximum downward movement during the exercise corresponding to the amount of downward movement of the rearward end portion of the user's foot on said rearward end portion of said right pedal applied by the user during the exercise; and said rearward end portion of said left pedal being downwardly movable relative to said forward end portion thereof in user variable downward amounts within a range of maximum downward movement during the exercise corresponding to the amount of downward movement of the rearward end portion of the user's foot on said rearward end portion of said left pedal applied by the user during the exercise.

84. The exercise apparatus of claim 83 wherein said pedal interconnect member moves said right pedal forward in a forward amount corresponding to a rearward amount of said rearward movement of said left pedal, and moves said left pedal forward in a forward amount corresponding to a rearward amount of said rearward movement of said right pedal.

85. The exercise apparatus of claim 83 wherein said right pedal is rearwardly movable in user variable rearward amounts within a range of maximum rearward movement during the exercise corresponding to the amount of rearward movement of the user's foot on said right pedal applied by the user during the exercise, and said left pedal is rearwardly movable in user variable rearward amounts within a range of maximum rearward movement during the exercise corresponding to the amount of rearward movement of the user's foot on said left pedal applied by the user during the exercise.

86. The exercise apparatus of claim 85 wherein said rearward end portion of said right pedal is independently downwardly movable with respect to said rearward and forward reciprocating movements of said right and left pedals, and said rearward end portion of said left pedal is independently downwardly movable with respect to said rearward and forward reciprocating movements of said right and left pedals.

87. An exercise apparatus for a user to exercise while standing on the user's feet, comprising:

right and left foot pedals, each having a forward end portion to receive a forward end portion of the user's corresponding foot thereon and a rearward end portion to receive a rearward end portion of the user's corresponding foot thereon, said right pedal being supported for rearward and forward reciprocating movement thereof while permitting said rearward end portion of said right pedal to move downward and upward relative to said forward end portion thereof, and said left pedal being supported for rearward and forward reciprocating movement thereof while permitting said rearward end portion of said left pedal to move downward and upward relative to said forward end portion thereof;

a pedal interconnect member engaging said right and left pedals, in response to said rearward movement of said left pedal, said pedal interconnect member moving said right pedal forward, and in response to said rearward movement of said right pedal, said pedal interconnect member moving said left pedal forward;

a right heel lift member engaging said right pedal to move said rearward end portion of said right pedal upward after said downward movement thereof; and a left heel lift member engaging said left pedal to move said rearward end portion of said left pedal upward after said downward movement thereof.

88. The exercise apparatus of claim 87 wherein said pedal interconnect member moves said right pedal forward in a forward amount corresponding to a rearward amount of said rearward movement of said left pedal, and moves said left pedal forward in a forward amount corresponding to a rearward amount of said rearward movement of said right pedal.

89. The exercise apparatus of claim 87 wherein said right and left heel lift members are operatively interconnected such that said right heel lift member moves said rearward end portion of said right pedal upward in response to said downward movement of said rearward end portion of said left pedal, and said left heel lift member moves said rearward end portion of said left pedal upward in response to said downward movement of said rearward end portion of said right pedal.

90. The exercise apparatus of claim 89 wherein said pedal interconnect member is operatively disconnected from said right and left heel left members with said rearward and forward reciprocating movements of said right and left pedals being independent of said upward and downward movements of said rearward end portions of said right and left pedals.

91. An exercise apparatus for a user to exercise while standing on the user's feet, comprising:

right and left foot pedals, each having a forward end portion to receive a forward end portion of the user's corresponding foot thereon and a rearward end portion to receive a rearward end portion of the user's corresponding foot thereon;

a right pedal support member supporting said right pedal for rearward and forward reciprocating movement of said right pedal in user variable rearward and forward amounts during the exercise along a right path, said variable rearward amount of said rearward movement of said right pedal corresponding to the amount of rearward movement of the user's foot on said right pedal applied by the user during the exercise, said right support member supporting said right pedal for downward and upward movements of said rearward end portion thereof relative to said forward end portion thereof in user variable downward and upward amounts during the exercise, said variable downward amount of said downward movement of said rearward end portion of said right pedal corresponding to the amount of downward movement of the rearward end portion of the user's foot on said rearward end portion of said right pedal applied by the user during the exercise;

a left pedal support member supporting said left pedal for rearward and forward reciprocating movement of said left pedal in user variable rearward and forward amounts during the exercise along a left path, said variable rearward amount of said rearward movement of said left pedal corresponding to the amount of rearward movement of the user's foot on said left pedal applied by the user during the exercise, said left support member supporting said left pedal for downward and upward movements of said rearward end portion thereof relative to said forward end portion thereof in user variable downward and upward amounts during the exercise, said variable downward amount of said downward movement of said rearward end portion of said left pedal corresponding to the amount of downward movement of the rearward end portion of the user's foot on said rearward end portion of said left pedal applied by the user during the exercise;

a first pedal interconnect member engaging said right and left pedals, in response to said rearward movement of said left pedal corresponding to the rearward movement of the user's foot on said left pedal applied by the user during the exercise, said first pedal interconnect member moving said right pedal forward, and in response to said rearward movement of said right pedal corresponding to the rearward movement of the user's foot on said right pedal applied by the user during the exercise, said first pedal interconnect member moving said left pedal forward; and a second pedal interconnect member engaging said right and left pedals, in response to said downward movement of said rearward end portion of said left pedal corresponding to the downward movement of the rearward end portion of the user's foot on said left pedal applied by the user during the exercise, said second pedal interconnect member moving said rearward end portion of said right pedal upward, and in response to said downward movement of said rearward end portion of said right pedal corresponding to the downward movement of the rearward end portion of the user's foot on said right pedal applied by the user during the exercise, said second pedal interconnect member moving said rearward end portion of said left pedal upward.

92. The exercise apparatus of claim 91 wherein said first pedal interconnect member moves said right pedal forward with said variable forward movement amount thereof corresponding to said variable rearward movement amount of said left pedal, and moves said left pedal forward with said variable forward movement amount thereof corresponding to said variable rearward movement amount of said right pedal.

93. The exercise apparatus of claim 91 wherein said second pedal interconnect member moves said rearward end portion of said right pedal upward with said variable upward movement amount thereof corresponding to said variable downward movement amount of said left pedal, and moves said rearward end portion of said left pedal upward with said variable upward movement amount thereof corresponding to said variable downward movement amount of said right pedal.

94. The exercise apparatus of claim 91 wherein said first pedal interconnect member moves said right pedal forward with said variable forward movement amount thereof corresponding to said variable rearward movement amount of said left pedal, and moves said left pedal forward with said variable forward movement amount thereof corresponding to said variable rearward movement amount of said right pedal, and said second pedal interconnect member moves said rearward end portion of said right pedal upward with said variable upward movement amount thereof corresponding to said variable downward movement amount of said left pedal, and moves said rearward end portion of said left pedal upward with said variable upward movement amount thereof corresponding to said variable downward movement amount of said right pedal.

95. The exercise apparatus of claim 91 wherein said first pedal interconnect member and said second pedal interconnect member are operatively disconnected such that movement of said right and left pedals rearward and forward are independent of movement of said rearward end portions of said right and left pedals downward and upward.

96. The exercise apparatus of claim 91 wherein said first pedal interconnect member includes a flexible member operatively interconnecting said right and left pedals.

97. The exercise apparatus of claim 91 wherein said second pedal interconnect member includes a flexible member interconnecting said right and left pedals.

98. The exercise apparatus of claim 91 wherein said first and second interconnect members together provides swinging support for said right and left pedals and limit downward travel thereof to provide uninhibited swinging movement of said right and left pedals out of supporting contact with any structure therebelow.

99. The exercise apparatus of claim 91, further including a resistance device operatively connected to said right and left pedals to resist said rearward movements thereof.

100. The exercise apparatus of claim 99 wherein said resistance device is connected to said first pedal interconnect member to resist said rearward movements of said right and left pedals, thereby resisting said rearward movements of said right and left pedals.

101. The exercise apparatus of claim 100 wherein said resistance device includes a rotatably mounted drive member to which said first pedal interconnect member transmits said rearward movements of said right and left pedals, said rearward movements of each of said right and left pedals being separately applied to said drive member to each rotate said drive member in a single rotational direction and thereby sum said separate rearward movements of said right and left pedals into a unidirectional rotational output of said drive member, said rotational output of said drive member being transmitted to a brake resisting rotation of said drive member, thereby resisting said rearward movements of said right and left pedals.

* * * * *